US011479952B2

(12) United States Patent
Rowe et al.

(10) Patent No.: US 11,479,952 B2
(45) Date of Patent: Oct. 25, 2022

(54) DOMESTIC WATER TAP

(71) Applicant: Greg Rowe Limited, Norwich (GB)

(72) Inventors: Gregory Norman Rowe, Norwich (GB); Iain James Prosser, Norwich (GB)

(73) Assignee: GREG ROWE LIMITED, Norwich (GB)

( * ) Notice: Subject to any disclaimer, the term of this patent is extended or adjusted under 35 U.S.C. 154(b) by 163 days.

(21) Appl. No.: 16/760,194

(22) PCT Filed: Oct. 31, 2018

(86) PCT No.: PCT/GB2018/053155
§ 371 (c)(1),
(2) Date: Apr. 29, 2020

(87) PCT Pub. No.: WO2019/086868
PCT Pub. Date: May 9, 2019

(65) Prior Publication Data

US 2020/0332502 A1 Oct. 22, 2020

(30) Foreign Application Priority Data

Oct. 31, 2017 (GB) ..... 1717969

(51) Int. Cl.
*E03C 1/04* (2006.01)

(52) U.S. Cl.
CPC ..... *E03C 1/0404* (2013.01); *E03C 1/0411* (2013.01); *E03C 1/0403* (2013.01);
(Continued)

(58) Field of Classification Search
CPC ... E03C 1/041; F16K 35/027; Y10T 137/9464
(Continued)

(56) References Cited

U.S. PATENT DOCUMENTS 3,998,240 A * 12/1976 Liautaud ..... F16K 19/006 137/375
7,344,094 B1 3/2008 Tracy et al.
(Continued)

FOREIGN PATENT DOCUMENTS

AT 405 968 B 1/2000
CN 101946046 A 1/2011
(Continued)

OTHER PUBLICATIONS

WO 2013/034757, Christ, Machine Translation, 2013 (Year: 2013).*
(Continued)

*Primary Examiner* — Daphne M Barry
(74) *Attorney, Agent, or Firm* — NSIP Law

(57) ABSTRACT

A domestic water tap (1000) is disclosed. The present application relates to a tap and an inner body for routing liquid within a tap, for example, a domestic water tap or faucet. The domestic water tap (1000) comprises an outer body (1010, 1012) and an inner body (100). The inner body (100) is housed within the outer body (1010, 1012). The outer body (1010, 1012) comprises at least one flow channel (1020, 1022) in which water can flow through the tap (1000) without contacting the outer body (1010, 1012). The inner body (100) is made from plastics and comprises at least one non-threaded bore for securely receiving a connector for delivering water from a source into the inner body (100).

27 Claims, 19 Drawing Sheets

(52) U.S. Cl.
CPC .. *E03C 2001/0415* (2013.01); *E03C 2201/30* (2013.01); *E03C 2201/40* (2013.01); *Y10T 137/9464* (2015.04)

(58) Field of Classification Search
USPC ..... 137/801
See application file for complete search history.

(56) References Cited

U.S. PATENT DOCUMENTS

| | | | | |
|---|---|---|---|---|
| 2012/0168000 | A1* | 7/2012 | Gioira | E03C 1/0411 137/334 |
| 2012/0267455 | A1 | 10/2012 | Hansen | |
| 2013/0192686 | A1 | 8/2013 | Zhu et al. | |
| 2013/0283522 | A1* | 10/2013 | Novak | E03C 1/0404 4/678 |
| 2014/0116553 | A1 | 5/2014 | Schoolcraft et al. | |
| 2014/0290774 | A1* | 10/2014 | Chung | E03C 1/0404 137/801 |
| 2014/0345725 | A1 | 11/2014 | Cai | |
| 2016/0177551 | A1 | 6/2016 | Li et al. | |
| 2018/0195711 | A1* | 7/2018 | Schneider, II | E03C 1/057 |

FOREIGN PATENT DOCUMENTS

| | | | |
|---|---|---|---|
| CN | 204213389 | U | 3/2015 |
| EP | 2 415 936 | A2 | 2/2012 |
| EP | 2 415 936 | A3 | 11/2012 |
| EP | 2 990 703 | B1 | 10/2019 |
| WO | WO 97/17501 | A1 | 5/1997 |
| WO | WO 98/48120 | A1 | 10/1998 |
| WO | WO 2008/125865 | A1 | 10/2008 |
| WO | WO 2009/102437 | A1 | 8/2009 |
| WO | WO 2013/034757 | A1 | 3/2013 |
| WO | WO 2017/042586 | A1 | 3/2017 |

OTHER PUBLICATIONS

Chinese Office Action dated Mar. 26, 2021 in Counterpart Chinese Patent Application No. 201880083859.X(Nine pages in Chinese).
Chinese Office Action dated Mar. 26, 2021 in Counterpart Chinese Patent Application No. 201880083859.X (5 pages in English and 9 pages in Chinese).
International Search Report dated Feb. 7, 2019 in counterpart International Patent Application No. PCT/GB2018/053155 (6 pages in English).
Written Opinion of the International Searching Authority dated Feb. 7, 2019 in counterpart International Patent Application No. PCT/GB2018/053155 (7 pages in English).

* cited by examiner

DOMESTIC WATER TAP

CROSS REFERENCE TO RELATED APPLICATIONS

This application is a U.S. National Stage Application of International Application No. PCT/GB2018/053155, filed on Oct. 31, 2018, which claims the benefit under 35 USC 119(a) and 365(b) of British Patent Application No. 1717969.8, filed on Oct. 31, 2017, in the United Kingdom Intellectual Property Office, the entire disclosure of which is incorporated herein by reference for all purposes.

FIELD

The present invention relates to a tap and an inner body for routing liquid within a tap, particular a domestic water tap or faucet.

BACKGROUND

Various types of taps are known, including single lever or dual lever taps which deliver a mixture of hot and cold water from mains sources as well as dual lever taps which deliver water from a plurality of sources, including mains sources, filtered water sources, near boiling or boiling water sources or carbonated water sources. The parts of the tap body which contact water must be manufactured from a material which is approved for domestic water use. Typically metals such as brass are used. Such materials are expensive and may also become hot.

As described, for example in WO2017/042586 to the present applicant, this can be addressed by providing a tap having a valve which is mounted within a housing and spaced from the exterior wall of the housing. In use, water is routed through the valve but heat transfer to the housing is minimised. Thus, the material for the housing can be freely selected based on cost considerations and/or aesthetic or tactile criteria.

The applicant has recognised that where internal components of the tap are housed within a separate housing, these internal components need to be securely mounted within the housing and to be robustly connected to the respective water sources.

SUMMARY

According to a first aspect of the invention, there is provided a tap comprising an outer body; an inner body which is housed within the outer body and which comprises at least one flow channel in which water can flow through the tap without contacting the outer body; wherein the inner body is made from plastics and comprises at least one non-threaded bore for securely receiving a connector for delivering water from a source into the inner body.

The inner body may be made from any plastics material which is approved for use in domestic water supplies, for example the inner body may be made from polyoxymethylene (also known as acetal), nylon, PTFE or polypropylene. The plastics material is preferably stable, particularly at the temperatures of the water sources (e.g. 0 to 40 degrees for mains sources, between 0 to 100 degrees Celsius for a tap which dispenses boiling water). For an inner body which is used with sources that deliver boiling water (e.g. water at or around 100 degrees Celsius) or near boiling water (between 95 to 100 degrees Celsius), the plastics material must be suitable for use at these higher temperatures. There are various advantages of using a plastics material when compared to metal, including lower conductivity which is particularly useful for boiling or near boiling applications because the use of an insulating inner body reduces heat transfer to the outer body which a user will contact. The use of a separate inner body also allows for a wider variety of outer bodies, including single piece outer bodies or two piece outer bodies. The outer bodies may also be made from a variety of materials, including metal. The plastics material may also be cheaper than metals which are approved for domestic use.

Polyoxymethylene, PTFE or nylon are plastics material which are suitable for near boiling and boiling water use. Thus, we also describe a tap comprising an outer body; an inner body which is housed within the outer body and which comprises at least one flow channel in which water can flow through the tap without contacting the outer body; wherein the inner body is made from polyoxymethylene. The inner body may comprise at least one non-threaded bore for receiving a connector for delivering water from a source into the inner body. It will be appreciated that this arrangement and the arrangement described above can be combined with the features described below.

The applicant has recognised that it is possible to connect the connectors to the tap by providing at least one non-threaded bore in the inner body to receive the connector. Not screwing the connector into the inner body may be beneficial. For example, the non-threaded bore may be sized to allow the connector to rotate within the non-threaded bore. When screwing a connector to a tap, it is possible a plumber may twist the connector and its associated hose and the twisting may damage the hose. In this arrangement, the connector may simply be pushed into the non-threaded bore and thus damage by twisting is avoided. A possible disadvantage of plastics materials, particularly cheaper plastics materials, is that a threaded bore cannot be reliably used as a method of fixing the connectors from the water sources into the inner body because the threaded bore may be weak and degrade over time. This is addressed by the use of the non-threaded bore. It will be appreciated a non-threaded bore may also be used in other materials, such as metal.

The non-threaded bore may itself be configured to provide a secure connection, e.g. by providing an interference fit for the connector. For example, the diameter of the non-threaded bore may have a size such that an O-ring or similar flexible or resilient member mounted on a surface of or in a groove in a surface of the connector may form such an interference fit. Such a seal may also form a water tight seal when the connector is pushed into the non-threaded bore and the resilient member is deformed. Alternatively, or additionally the tap may also comprise a clamping mechanism to secure the connector to the inner body. The inner body may comprise a further non-threaded bore in its base and wherein a hose retaining member is secured to the inner body with a fixing inserted in the further non-threaded bore to secure the connector to the inner body.

There may be at least one threaded bore in the outer body. The outer body may thus be made from metal or another suitable material (e.g. a higher grade of plastics) which supports a threaded bore. The tap may further comprise at least one threaded clamping stud. The at least one threaded bore may be in the base of the outer body and the tap may further comprise at least one threaded clamping stud which is located in the at least one threaded bore. The at least one clamping stud may, in use, abut against a hose retaining member to secure the connector to the inner body. Additionally or alternatively, the at least one clamping stud may be used as part of a clamping mechanism to secure the tap to a work surface. As explained in more detail, the threaded bore may also be used to stabilise the inner body within the outer body.

The tap may further comprise a work surface securing mechanism to secure the tap to a work surface, the work surface securing mechanism comprising at least one clamping nut which in use is located under a work surface, wherein the at least one clamping stud is located in the at least one threaded bore in the outer body and in a threaded bore in the at least one clamping nut. Two clamping studs may be used to provide additional stability. The clamping may be direct or via additional components as described below. The clamping mechanism may be external to the inner body but yet still secures the tap to the work surface in use.

The use of a plastics inner body and a metal (or other material) outer body may provide an arrangement in which the plastics inner body has a non-threaded bore and the metal outer body has a threaded bore. Thus, we also describe a tap comprising an outer body; an inner body which is housed within the outer body and which comprises at least one flow channel in which water can flow through the tap without contacting the outer body; wherein the inner body is made from plastics and comprises at least one non-threaded bore for receiving a connector for delivering water from a source into the inner body; and wherein the outer body is made from metal and comprises at least one threaded bore. It will be appreciated that this arrangement and the arrangements described above can be combined with the features described below. As described below, the at least one threaded bore in the inner surface of the outer body may be used to stabilise the inner body within the outer body and/or to clamp the tap to a work surface.

The inner body may comprise two, three or four non-threaded bores depending on the nature of the tap. For example, in a single lever or dual lever mixer tap which is mixing hot and cold mains water, the inner body may comprise two non-threaded bores, one for receiving a connector which connects the inner body to a cold water mains source and one for receiving a connector which connects the inner body to a hot water mains source. Alternatively, in a dual lever boiling water tap, the inner body may comprise four non-threaded bores, one for receiving a connector which connects the inner body to a cold water mains source, one for receiving a connector which connects the inner body to a hot water mains source, one for receiving a connector which connects the inner body to a boiling water source, and one for receiving a connector which connects the inner body to another source, e.g. a filtered water source.

The tap may further comprise at least one valve which is housed within the outer body and which is activated or controlled by a user, e.g. using a lever, to control water flow through the tap. For example, in a single lever mixer tap which is mixing hot and cold mains water, the tap may comprise a mixer valve which is controlled by the single lever for mixing the hot and cold water. Alternatively, in a dual lever mixer tap which is mixing hot and cold mains water, the tap may comprise a pair of mixer valves, one each for hot and cold water with each valve being operated by a separate lever. Alternatively, in a dual lever mixer tap which delivers boiling water as well as mixed mains water, the tap may comprise a mixer valve for mixing the hot and cold water and a selector valve for selecting boiling water or another type of water, e.g. filtered water. Such mixer and selector valves are known in art, for example as described in EP2990703 to the present applicant.

The at least one valve may be connected to the at least one flow channel in the inner body whereby water flows through the inner body and the at least one valve without contacting the outer body. An end of the at least one valve may be located in an indentation in the inner body. In the taps comprising two valves, the inner body may comprise a pair of indentations on opposed surfaces; one for each valve. Each indentation may be configured so that the end is a snug fit in the indentation to provide a good fluid connection between the at least one valve and the at least one flow channel in the inner body. A resilient seal, e.g. an O-ring, may be provided around the inner body below the indentation to provide a seal with an inner surface of the outer body to prevent water leaking through the tap in the event of a failure of the at least one valve or the connection between the inner body and the at least one valve.

The inner body may be a unitary body. Alternatively, the inner body may comprise at least two connecting components.

The inner body may comprise at least one non-threaded bore for receiving at least one threaded clamping stud and an indentation in its outer surface for receiving at least one clamping insert. The clamping insert may comprise a threaded bore which is aligned with a corresponding non-threaded bore in the inner body. The inner body may comprise a pair of clamping inserts located in indentations on opposed outer surfaces and a pair of non-threaded bores. In use, each clamping stud may be received through the corresponding non-threaded bore and secured to the clamping insert and hence to the inner body. The use of a clamping insert once again avoids the need for a threaded bore in the plastics inner body but provides a robust connection between the inner body and the clamping stud. The clamping insert may made from metal or a similar material which reliably holds a threaded bore. The clamping insert may be shaped to match the outer shape of the inner body and/or to have as large a surface area as possible without interfering with the channels through to the inner body to spread the clamping load. Each clamping stud and insert may be considered to form a clamping mechanism for securing the inner body to the connector. The or each indentation may be approximately one-third of the way along the length of the inner body to provide greater stability for the connection. Thus the or each non-threaded bore may extend along approximately a third of the length of the inner body. Similarly, it will be appreciated that the use of a pair of clamping studs and inserts improves the stability of the connection. The outer body may comprise a corresponding threaded bore into which the or each clamping stud may then also be screwed to form a robust connection between the inner body and the outer body.

There may be an alternative or additional mechanism for securing the inner body to the outer body. The tap may comprise a stabiliser having a threaded surface which engages with a threaded bore on an inner surface on the outer body. The stabiliser may be mounted on an upper or lower end of the inner body or there may be a pair of stabiliser, one or each end of the inner body. The inner body may thus comprise a projection from its upper and/or lower surfaces. The or each projection may have a narrower diameter than the inner body. Each stabiliser may be generally annular. For example, a stabiliser in the form of a body retaining nut may be received on an upper projection and a stabiliser in the form of a threaded ring may be received on a lower projection.

The inner body may also comprise a bore in its base for receiving a fixing to secure the at least one connector to the inner body. This provides another mechanism for securing the at least one connector to the inner body. As above, the securing may be direct or indirect, for example, the bore may receive a fixing which secures a retaining member to the inner body, the at least one connector being removably attached to the retaining member as described in more detail below. The fixing and the retaining member may thus be considered to be a clamping mechanism or a component of the clamping mechanism.

The inner body may comprise a first part having the at least one non-threaded bore and a second part located in a recess on an upper surface of the first part. The second part may be removably connectable to the first part, e.g. by an interference connection or "push" fit. The second part may comprise a projection which is received in a corresponding recess, e.g. a water outlet, of the inner body. A two-part inner body may be simpler to manufacture and install. The first part may comprise a contact portion on its base which is shaped to match a hose retaining member which in use contacts the first part and which secures a connector in the at least one non-threaded bore. For example, in a system using a generally planar hose retaining member, the contact portion may also be generally flat.

In a tap having at least one valve, the first part may be connected to the at least one valve. The second part may be connected to a spout of the tap. An end of the at least one valve may be located in a recess in the first part. The first and/or second parts may have a tap engaging surface which extends around the recess and which engages with an inner surface of the outer body to help to secure the inner body within the tap to prevent movement of the inner body. The tap engaging surface may comprise a plurality of fins to increase the surface area and thus increase the cooling effect at the tap engaging surface and/or allows for non-radial expansion of the inner body to prevent increased force on the inner surface of the outer body. This helps to reduce heat transmission to the outer body and/or provides for non-radial expansion of the inner body to avoid increasing the radial pressure on the inner surface of the outer body as the heat rises. The fins may be uniform in size or may have a size selected according to the thermal transmission in that location within the tap.

The second part may comprise a channel housing an O-ring or other resilient seal which in use provides a water tight seal with an inner surface of the outer body. When the second part is connected to the spout, the resilient seal may prevent leakage into the tap body if the spout fails. Similarly, the first part may comprise at least one channel housing an O-ring or other resilient seal which in use provides a water tight seal with an inner surface of the outer body. The at least one channel may encircle the recess into which the end of the at least one valve is located and thus the seal may prevent leakage into the tap body if the at least one valve fails. Thus, in the arrangement having two valves, there may be channels on opposed sides of the inner body.

The tap described above may be connected to a plurality of water sources. Thus, the tap may form part of a system which comprises the tap described above and at least one hose for connecting the tap to a water source, the at least one hose comprising a connector for delivering water from the source into the inner body. The system may comprise two, three or four hoses, each with its own connector depending on the nature of the tap. For example, in a single lever or dual lever mixer tap which is mixing hot and cold mains water, there may be two hoses, one for cold water and one for hot water. Alternatively, in a dual lever boiling water tap, there may be four hoses, one for cold water, one for hot water, one for boiling water (or near boiling water) and one for another type of water (e.g. filtered water).

The system may comprise a hose retaining member having a slot for each connector and the connector may be releasably mounted in a corresponding slot. The hose retaining member may be secured to the inner body with a fixing (e.g. a self-tapping screw) which is secured in a non-threaded bore in the base of the inner body. This is one method for securing the connector to the inner body and thus the fixing and the hose retaining member can be considered to form a clamping mechanism. Alternatively, or additionally to connect the connector to the inner body, the at least one clamping stud may be screwed in through the threaded bore in the outer body so that one end of the at least one clamping stud abuts the hose retaining member to keep the hose retaining member in contact with the base of the inner body. The at least one clamping stud may ensure that there is good contact between the hose retaining member and a contact portion on the base of the inner body. In this arrangement, the clamping stud and the hose retaining member may be considered to form a clamping mechanism. It will be appreciated that the clamping mechanism may comprise the combination of the hose retaining member, the fixing and the clamping stud.

The system may further comprise a base member (also referred to as a base insert and the terms may be used interchangeably). The base member surrounds the at least one hose and is secured to the base of the outer body, for example by the contact with the work surface when the tap is installed. The base member may comprise a plurality of flanges (e.g. three or four) which extend into the outer body and which contact on an inner surface of the outer body. The height of the flanges may be selected so that the flanges assist in urging the hose retaining member to contact the inner body whereby there is a good connection between the connector and the inner body. The base member may also comprise a slot to support an LED or similar indicator within an aperture in the outer body. The LED or indicator may be used to indicator to a user that the tap is ready for use, particularly where a boiling water source is being used. The base member may also comprise at least one aperture which receives the at least one clamping stud. In this arrangement, the clamping mechanism may comprise the base member alone or with the clamping stud.

A resilient seal, e.g. an O-ring, may be attached to the or each connector to provide a seal against the or each non-threaded bore of the inner body. In this arrangement, the clamping mechanism may comprise the resilient seal.

The system may further comprise one or more water sources described above, including a boiling water source.

The inner body may be provided as a piece to be inserted into a tap. Thus, according to another aspect of the invention there is provided an inner body for a tap, the inner body being configured to be received in an outer body of the tap, the inner body comprising at least one flow channel in which water can flow through the tap without contacting the outer body, wherein the inner body is made from plastics and comprises at least one non-threaded bore for receiving a connector for delivering water from a source into the inner body. The inner body may comprise the features described above.

Similarly, the system may comprise a connection mechanism comprising the at least one hose having a connector which is configured to be received in a non-threaded bore in an inner body of a tap and one or both of a hose retaining member and a base member to secure the connector to the inner body to deliver water from the hose to the inner body.

The connection mechanism may comprise the further details of the connector, hose retaining member and the base member described above. The hose retaining member and/or the base member may form part of a clamping mechanism to secure the connector to the inner body as described above.

BRIEF DESCRIPTION OF DRAWINGS

Further features and advantages of the invention will become apparent from the following description of preferred embodiments of the invention, given by way of example only, which is made with reference to the accompanying drawings.

DESCRIPTION OF EMBODIMENTS

Figure 1A:
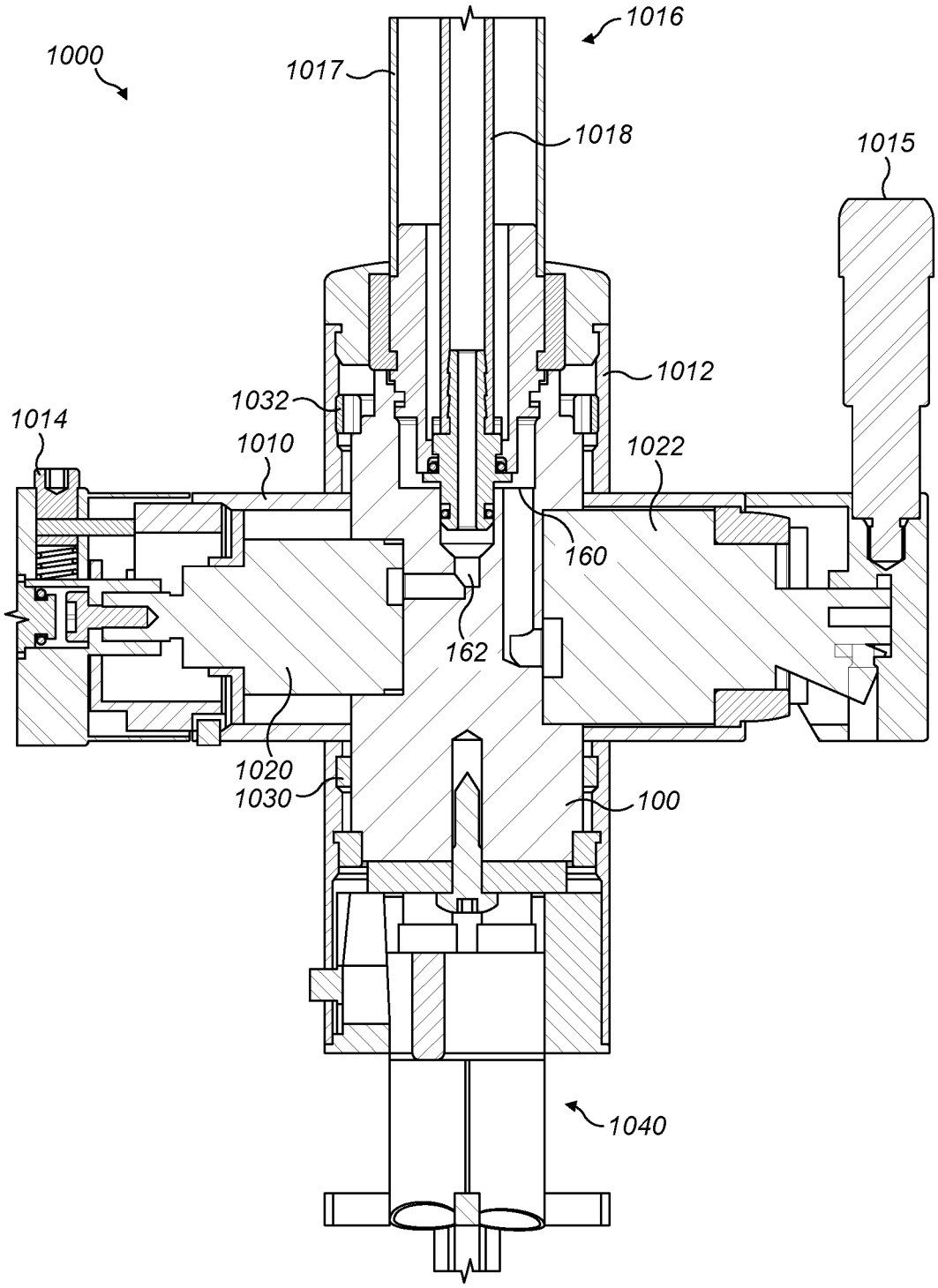
FIG. 1*a* shows a cross-sectional view of a tap according to a first example.
Figure 1B:
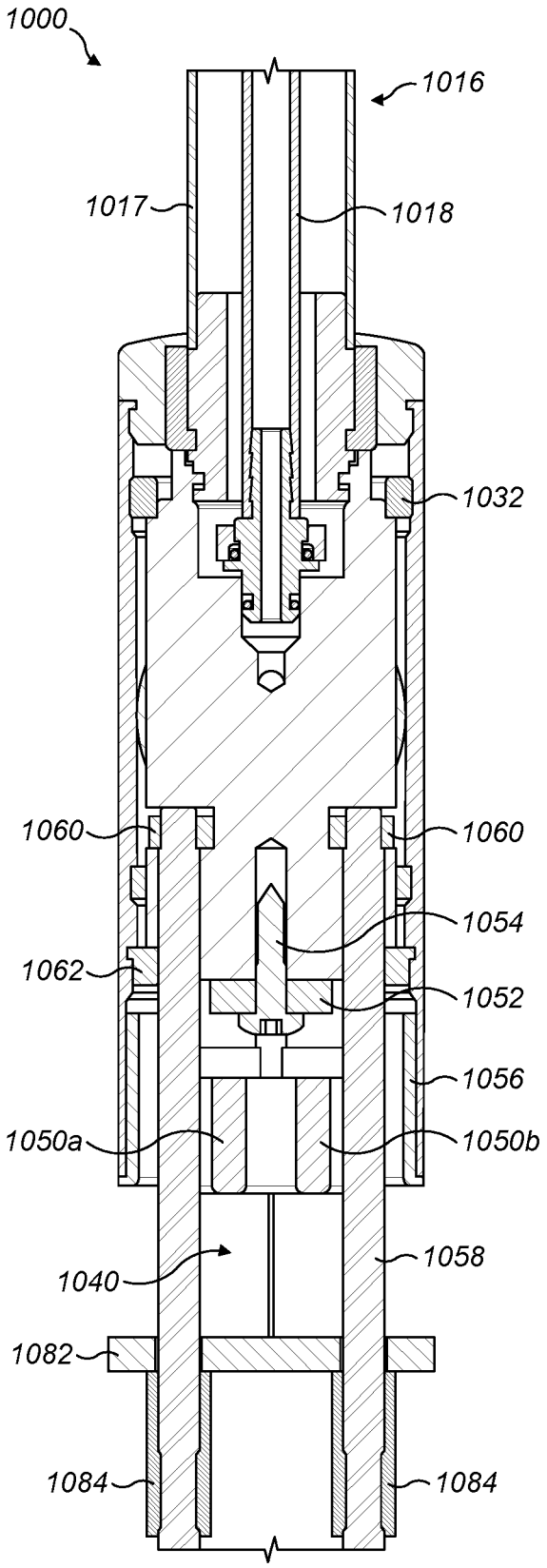
FIG. 1*b* shows another cross-sectional view of the tap of FIG. 1*a;*
Figure 1C:
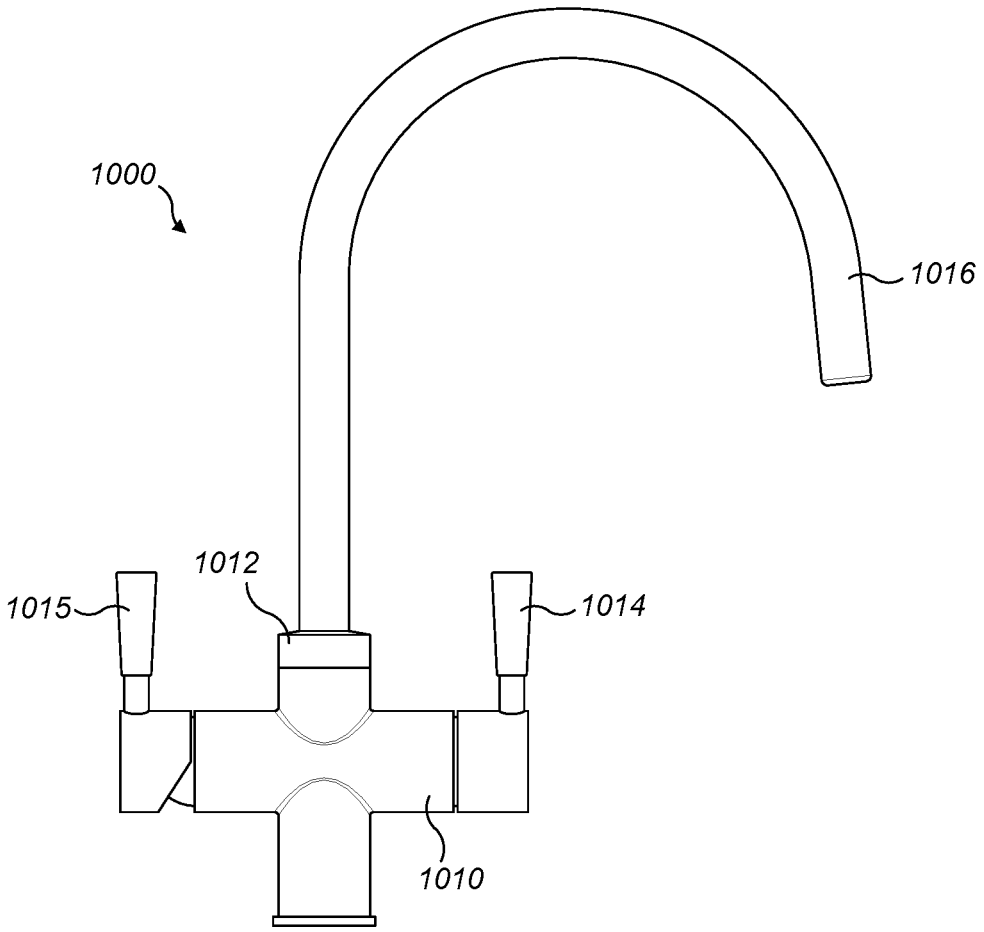
FIG. 1*c* is a front view of a variant of the tap of FIG. 1*a;*

Referring to FIGS. 1*a* to 1*c*, there is illustrated a first example of a water tap 1000 including a tap inner body 100 of the type described in more detail below. In this example, the tap 1000 is a so-called "4 in 1 boiling water tap".

The tap 1000 comprises a first outer body piece 1010 and a second outer body piece 1012 which are arranged substantially at right angles to one another and are cross-shaped in cross-section. When installed at a sink unit (not shown) or other work surface, the second outer body piece 1012 will typically extend substantially vertically with respect to the work surface. The tap 1000 further comprises a cylindrical spout 1016 which is connected to and extends from the second outer body piece 1012. As explained in more detail below, water routes through an inner body 100 which is housed within the tap so that the first outer body piece 1010 and the second outer body piece 1012 do not come into contact with any water flowing through the tap.

The first outer body piece 1010 houses a first valve 1020 and a second valve 1022. The first valve 1020 interfaces with one side of the inner body 100 and the second valve interfaces with an opposed side of the inner body 100 that is opposite the first side. In this example, the first valve 1020 is a filtered water and boiling water selector valve which allows a user to select filtered water or boiling water but not a mixture of filtered and boiling water. The second valve is a mains hot and cold water mixer valve 1022 which allows a user to mix hot and cold water in any combination. The tap 1000 further comprises a first handle 1014 operatively connected to the first valve 1020 and a second handle 1015 operatively connected to the second valve 1022. In the embodiment shown in FIG. 1*a*, the first handle 1014 does not include a lever like the second handle 1015. However, as appreciated the type of handle can be selected to suit a particular user's requirements. FIG. 1*c* shows a modification of the tap of FIG. 1*a* in which both handles have an external activating lever.

By activating the first handle 1014, a user can control the valve 1020 to cause water from the filtered water source or boiling water source to flow through the tap 100 and be dispensed through an inner outlet 1018 within the spout 1016. By activating the second handle, a user can control the valve 1010 to cause water from hot and cold water sources to flow through the tap 100 and be dispensed through an outer outlet 1017 within the spout 1016. The inner outlet 1018 is concentrically mounted within the inner outlet 1017. Such handles, their mechanism and the manner in which they control valves such as the valves 1020 and 1022 are known for example from WO2017/042586 and EP2990703 to the present applicant. The information contained in these publications is herein incorporated by reference.

Figure 1D:
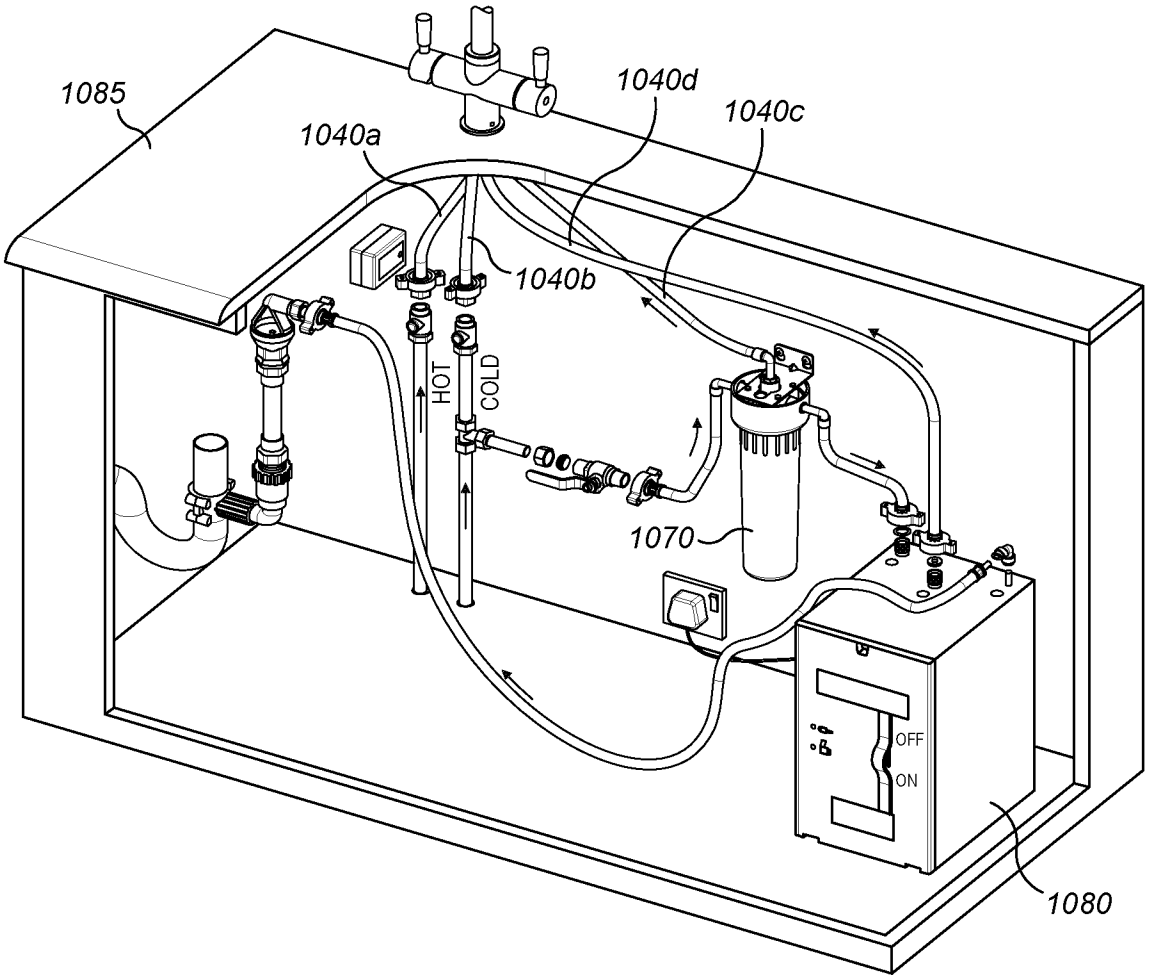
FIG. 1*d* is a cutaway schematic showing the tap of FIG. 1*a* connected to various sources.

As shown in FIG. 1*d*, four hoses 1040*a*, 1040*b*, 1040*c*, 1040*d* are provided to supply water from water sources to the inner body 100 in the tap 1000. In this example, a first hose 1040*a* connects the tap to a mains hot water source, a second hose 1040*b* connects the tap to a mains cold water source, a third hose 1040*c* connects the tap to a filtered water source 1070 and a fourth hose 1040 connects the tap to a boiling filtered water source 1080. The hoses may comprise a rubber (or similar flexible material) in a braided stainless steel outer (or similar more robust protective housing). Alternatively, the hoses may comprise a copper pipe onto which the connector is soldered.

The boiling water source is in the form of a boiler which has a compact design that can be easily fitted into a standard kitchen cabinet. The compact design may hold over 4 litres. The boiler is connected to a water supply and a power source. The boiler is insulated and efficient so that it uses very little power to keep the water at around 100° C. (and above 98° C.). For example, the boiler may consume less than 1 watt of electricity per hour in standby mode. The boiler operates at a minimum pressure of 1.5 bar for hot and cold supply and up to a maximum pressure of 5 bar.

Figure 1E:
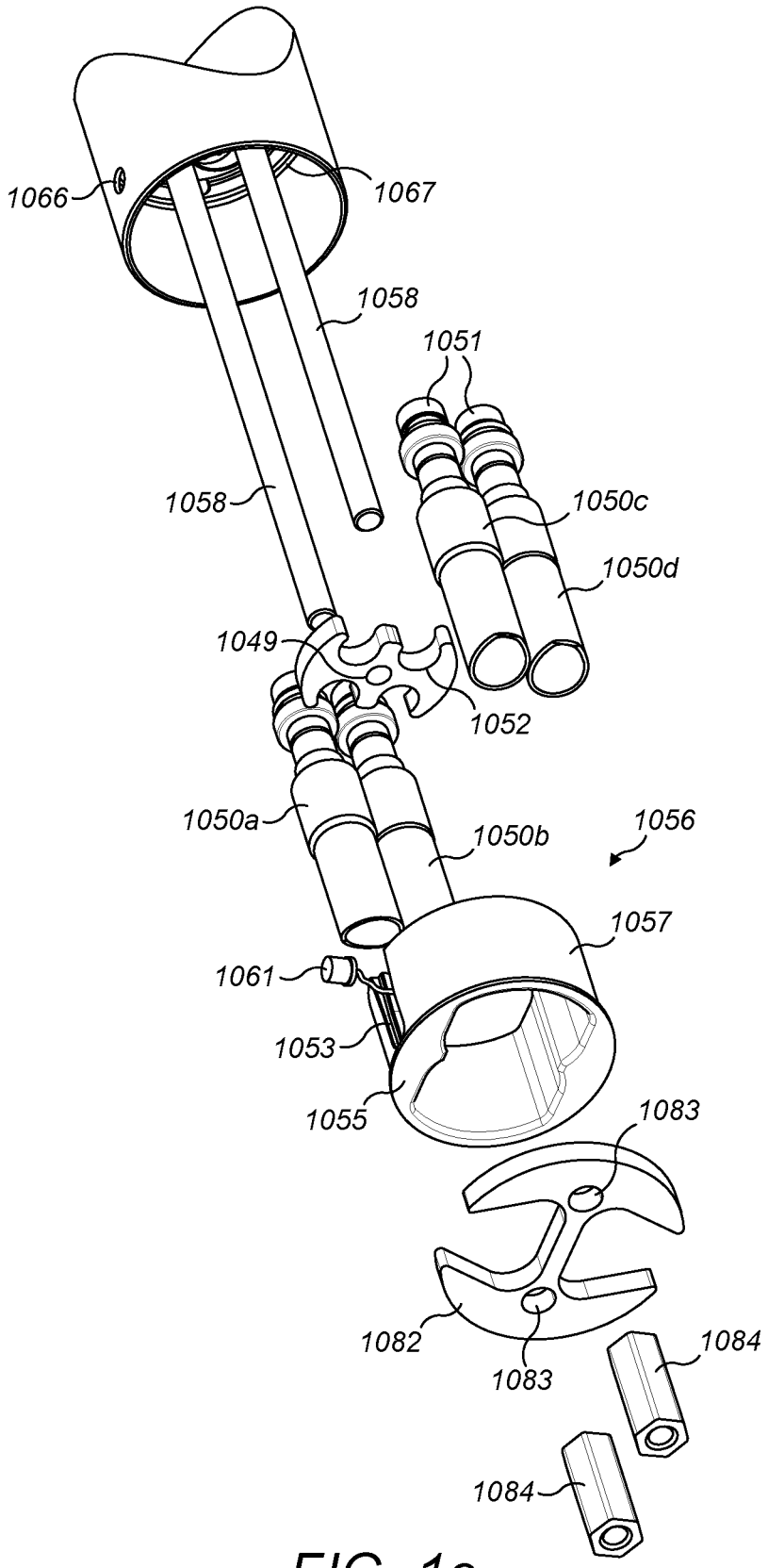
FIG. 1*e* is an exploded isometric view showing various components in the tap of FIG. 1*a;*

As shown in FIG. 1*e*, each of the four hoses has a connector 1050*a*, 1050*b*, 1050*c*, 1050*d* and each connector is releasably attached to a hose retaining member 1052. A generally cylindrical-like base insert 1056 is arranged below the hose retaining member 1052 and encircles the four hoses. As shown in FIGS. 1*a* and 1*b*, each of the connectors is received in a corresponding bore within the inner body 100. The use of non-threaded bores in the inner body 100 means that the inner body 100 can be made from materials such as plastics which are typically too weak to maintain a threaded bore. The bores and the connectors are non-threaded and the connectors are secured at least in part by a push fit. Each of the connectors comprises an O-ring 1051 which provides a seal to prevent water leaking around the outside of the hoses. The O-ring 1051 may also at least partially secure the connector in the non-threaded bore by providing an interference fit. The connectors may also be free to turn in the bores.

The hose retaining member 1052 has four slots each of which receive a connector and hold the connectors in place relative to one another to ensure accurate alignment with the bores when the connectors are inserted in the inner body 100. The hose retaining member 1052 may be secured to the inner body 100, for example, by a self-tapping screw 1054 which is received in an aperture 1049 in the hose retaining member 1052 and a corresponding bore in the base of the inner body. The hose retaining member 1052, the self-tapping screw 1054 and bore in the inner body base thus form a clamping mechanism which ensures that the connectors 1050*a*, 1050*b*, 1050*c*, 1050*d* are securely held within the non-threaded bores.

The base insert 1056 comprises a generally annular ring 1055 with a flange 1057 extending perpendicularly to the annular ring. When the base insert 1056 is inserted into the base of the tap body, the flange 1057 contacts the inner walls of the tap body. A slot 1053 in the flange supports an LED 1061 or similar light and the flange pushes the LED through a corresponding aperture 1066 in the outer body so that it is visible in use to a user. The LED 1061 may be used to indicate whether or not boiling water is currently available if the tap is in a "4 in 1 system". In use, the base insert 1056 rests on the work surface which holds the base insert in place. The base insert acts as a seal at the base of the tap body to reduce leakage from the tap. The height of the flange 1057 is such that the flange 1057 contacts the base of the connectors and/or the hose retaining member to help hold them in place within the non-threaded bores.

The tap (or a system incorporating the tap) also comprises a pair of elongate clamping studs 1058 may also be used to robustly connect the inner body 100 and hence the tap to a work surface. A work surface securing member 1082 is spaced from the tap body by the height of the work surface. The securing member 1082 abuts and thus co-operates with a pair of securing nuts 1084 each of which have a threaded bore and each of which engage a respective elongate clamping stud 1058. The elongate clamping studs 1058 are screwed into the threaded bore on the securing nut 1084 to ensure a robust connection of the tap to the work surface. The use of such a work surface clamping arrangement may control the amount of force applied by a plumber when fitting the tap to the work surface and thus reduce any damage done to the connections between the connectors and the inner body or other parts of the tap during fitting.

Figure 1F:
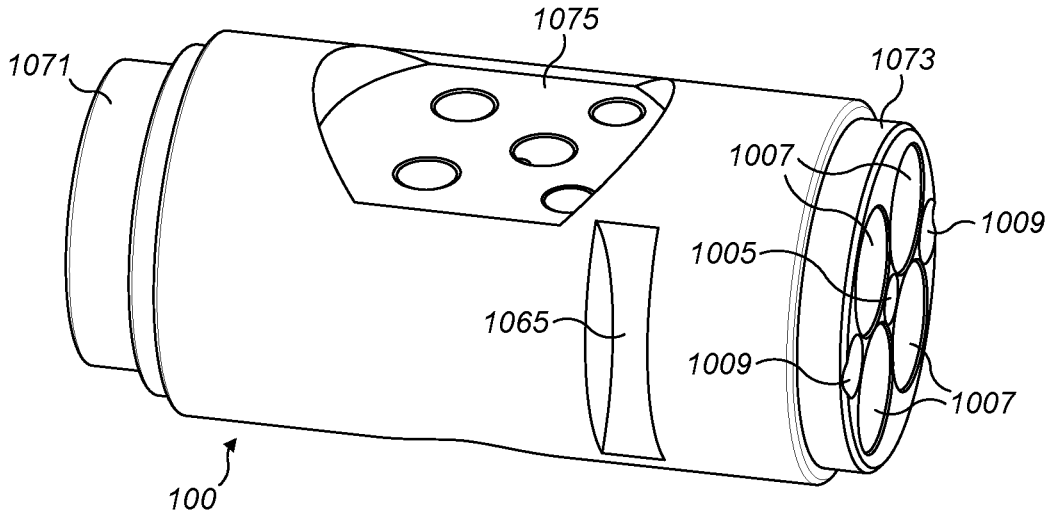
FIG. 1*f* is a perspective view of an inner body for the tap of FIG. 1*a;*
Figure 1G:
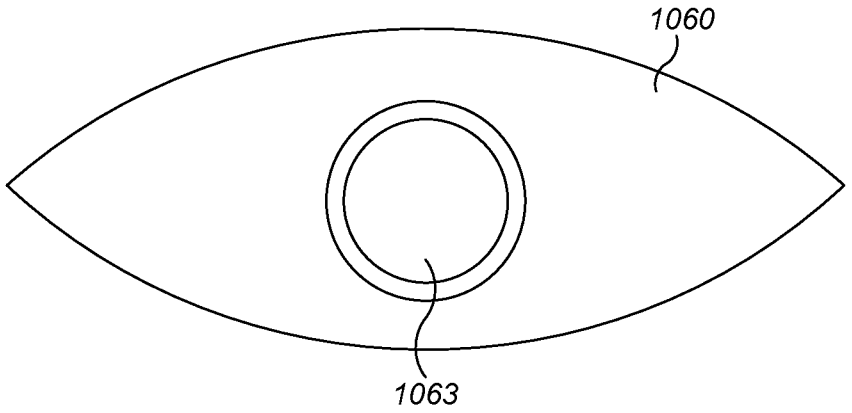
FIG. 1*g* is a plan view of a clamping insert for the inner body of FIG. 1*f;*
Figure 1H:
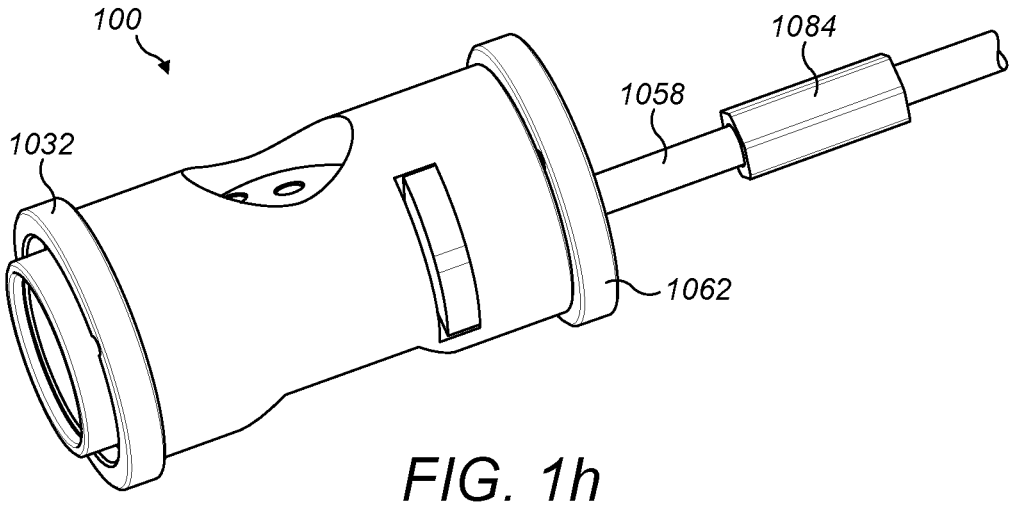
FIG. 1*h* is a perspective view of the inner body of FIG. 1*f* with the clamping insert.

As shown in FIGS. 1*b*, 1*f* and 1*h*, the inner body 100 comprises a pair of indentations 1065 on opposed sides of the inner body, each of which is aligned with a non-threaded bore 1009 which receives a respective clamping stud. The non-threaded bores are on opposed sides of the inner body and do not interfere with the four non-threaded bores 1007 which each receive a connector. A central non-threaded bore 1005 is also shown in the base of the inner body for receiving the self-tapping screw. Each indentation receives a clamping insert 1060, an example of which is shown in FIG. 1*g*. The clamping inserts are made from metal or another material in which it is suitable to provide a threaded bore 1063. In the example shown, the clamping insert has a generally elliptical or lens-shaped cross-section. The use of a generally elliptical shape allows the insert to have the maximum surface area for distributing the load from the clamping mechanism without interfering with the internal fluid path ways. Moreover, the curved shape matches the external curvature of the inner body. Alternatively, a more standard clamping nut may be used, for example an M6 nut made of stainless steel.

In the example shown in FIG. 1*h*, the clamping studs 1058 project almost one third of the way into the inner body 100. Each elongate clamping stud 1058 passes through a non-threaded bore and is secured in the respective clamping insert 1060 and in the respective threaded bore in the securing nut 1084. This provides a clamping mechanism for securing the tap to a work surface as described in more detail above and illustrated in FIG. 6 below.

As shown in FIGS. 1*f* and 1*h*, the inner body 100 has a generally cylindrical body with annular projections 1071, 1073 at opposed ends of the cylindrical body. The projections have a smaller diameter than the body. As shown in FIGS. 1*a*, 1*b* and 1*h*, a body retaining nut 1032 slots over the upper projection 1071 to connect the inner body 100 to the second outer body 1012 at an upper end and a threaded ring 1062 slots over the lower projection to secure the inner body 100 to the second outer body 1012 at a lower end. The body retaining nut 1032 and the threaded ring 1062 are both threaded and engage with threaded bores on the inner surface of the second outer body 1010 of the tap and stabilise the inner body 100 within the outer body of the tap. One of these threaded bores 1067 is shown clearly in FIG. 1*e*. The body retaining nut 1032 and the threaded ring 1062 are both generally annular. As shown in FIG. 1*h*, the upper projection 1071 may comprise a first portion which is enclosed by the body retaining nut 1032 and a second portion which protrudes from the body retaining nut. As shown in FIGS. 1*a* and 1*b*, the second, narrower portion abuts the base of the spout and thus helps to stabilise the spout.

As shown in FIGS. 1*a*, 1*f* and 1*h*, the inner body 100 also comprises two generally cylindrical indentations 1075 on opposed faces. These indentations are approximately centrally mounted along the length of the inner body 100. A first indentation receives an end of the first valve and a second indentation receives an end of the second value. As best seen in FIG. 1*a*, the tap 1000 is provided with an O-ring 1030 between the inner body 100 and the second outer body 1012 just below the indentations 1075 to prevent water from leaking underneath a work surface in the event of a failure of one of the valves 1020, 1022.

The tap 1000 shown in FIGS. 1*a* to 1*h* has four water sources, namely, mains cold, mains hot, filtered and boiling filtered water sources. In the water source system for feeding the tap 1000, the filtered water source may also feed water to a heater for providing boiling filtered water. By boiling water it is meant water at or around 100 degrees Celsius.

Near boiling water sources in the range of 95 to 100 degrees Celsius may also be used. The pre-filtration of the water which is to be boiled prevents e.g. calcification of the hot water tank during boiling. Further, the inner spout 1018 carries both the filtered water and boiling filtered water. If the boiling water was not filtered, the inner spout 1018 might become contaminated.

Figure 1I:
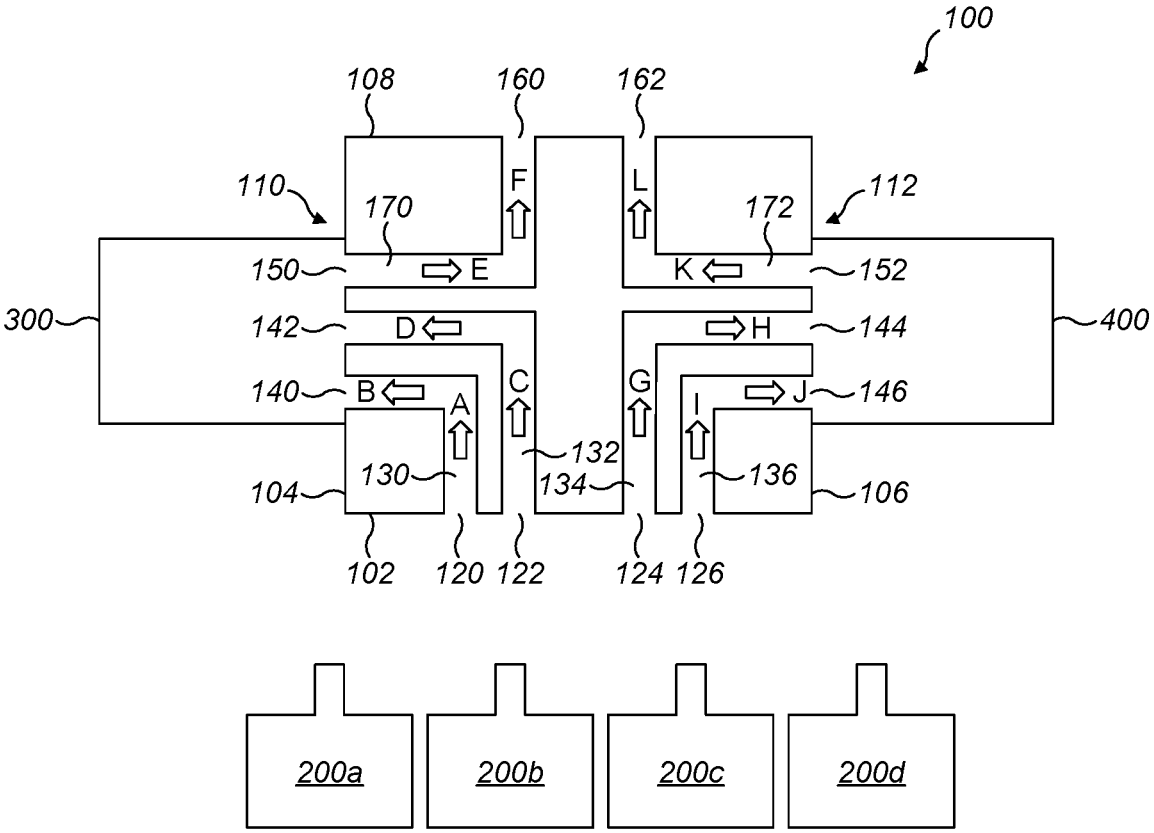
FIG. 1*i* shows a schematic view of the internal configuration of an inner body within the tap of FIG. 1*a;*

Referring to FIG. 1*i*, there is a shown a schematic view showing the routing of water through the tap inner body 100. The tap inner body 100 has a plurality of water inlets 120, 122, 124, 126 on a first surface 102 (in this example a lower surface). Each water inlet is for receiving water into the inner body 100 from a respective water source of a plurality of water sources 200*a*, 200*b*, 200*c*, 200*d*. Each of the plurality of water inlets 120, 122, 124, 126 is connected to a respective one of a plurality of water outlets 140, 142, 144, 146 by a respective one of a plurality of channels 130, 132, 134, 136 inside the inner body 100. As shown, two water outlets 140, 142 are in a second surface 104 and two water outlets 144, 146 are in a third surface 106 with the second and third surfaces being on opposed sides of the inner body 100.

There are also indentations 110, 112 on opposed faces of the inner body, each for receiving an appropriate valve. The first and second channels 130, 132 lead water to a mixer valve (not shown) in a first chamber 300, and the third and fourth channels 134, 136 lead water to a selector valve (not shown) in a second chamber 400. There is also at least one additional water inlet 150 on the second surface 104 which receives water from the chamber 300. Similarly, the inner body 100 has an additional water inlet 152 on the third surface 106 of the inner body 100 which receives water from the chamber 400. Water exits the inner body through at least one further water outlet 160 which is connected to the at least one additional water inlet 150 by at least one additional channel 170 inside the inner body 100 and/or through at least one further water outlet 162 which is connected to the at least one additional water inlet 152 by at least one additional channel 172 inside the inner body 100. Both of these further water outlets 160, 162 are on a fourth surface 108, which is opposite the first surface 102.

When the inner body shown in FIG. 1*i* is incorporated in the system shown above, by appropriately moving the second handle 1015, the user may set the mixer valve 1022 in chamber 300 to control the flow of mains cold water in the direction shown by arrows A and B and the flow of mains hot water in the direction shown by arrows C and D. The flow of mixed temperature water flows back into the inner body 100 in the direction shown by arrows E and F and exits the inner body 100 at outlet 160. In this example, the outlet 160 is in fluid communication with the outer spout 1017 of the spout 1016 and this water flow is dispensed from the outer spout 1017. As will be appreciated, by appropriately moving the second handle 1015, the user may also set the second valve 1022 so that just mains cold water or just mains hot water is dispensed from the outer spout 1017. Similarly, by appropriately activating the first handle 1014, the user may set the selector valve 1020 on chamber 200 to selectively activate either a flow of filtered boiling water in the direction shown by arrows G and H or a flow of filtered water in the direction shown by arrows I and J through the inner body 100. The selected flow then flows back into the inner body 100 in the direction shown by arrows K and L and out of the inner body 100 through outlet 162. In this example, the outlet 162 is in fluid communication with the inner spout 1018 of the spout 1016 and this water flow is dispensed from the inner spout 1018.

Water flows through the inner body and the valves without contacting the sides of the tap outer body. The tap inner body 100 may be made of plastics so that it can provide thermal insulation between water flowing inside it and any tap part within which it is located. This reduces the likelihood of a user injuring themselves by touching an overly hot external surface of the tap, for example. The tap inner body 100 may be made from any suitable plastics material include polyoxymethylene plastic (also known as acetal, polyacetal and polyformaldehyde), nylon (i.e. a synthetic polymers, based on aliphatic or semi-aromatic polyamides) and PTFE (i.e. polytetrafluoroethylene, a synthetic fluoropolymer of tetrafluoroethylene). These materials are relatively inert, easily manufacturable (by machining, moulding or other suitable techniques) have good thermal insulation and expansion properties. The material is also preferably lower cost that a metal which is suitable for domestic taps. The material must be approved for use and thus must also be "stable" at all temperatures of operation (including boiling), i.e. one which does not degrade or otherwise leach monomer into the water. Where there is no boiling water source, a different plastics material which is only stable at lower temperatures, e.g. polypropylene, may be used.

By reducing the total heat energy which is transmitted to an outer layer of the tap, the choice of material for the tap body can include materials which are not thermal insulators and also materials which are not approved for contact with drinking water. Thus, the tap body can be made from metal, including metals which are cheaper than those which are approved for drinking water.

Figure 2A:
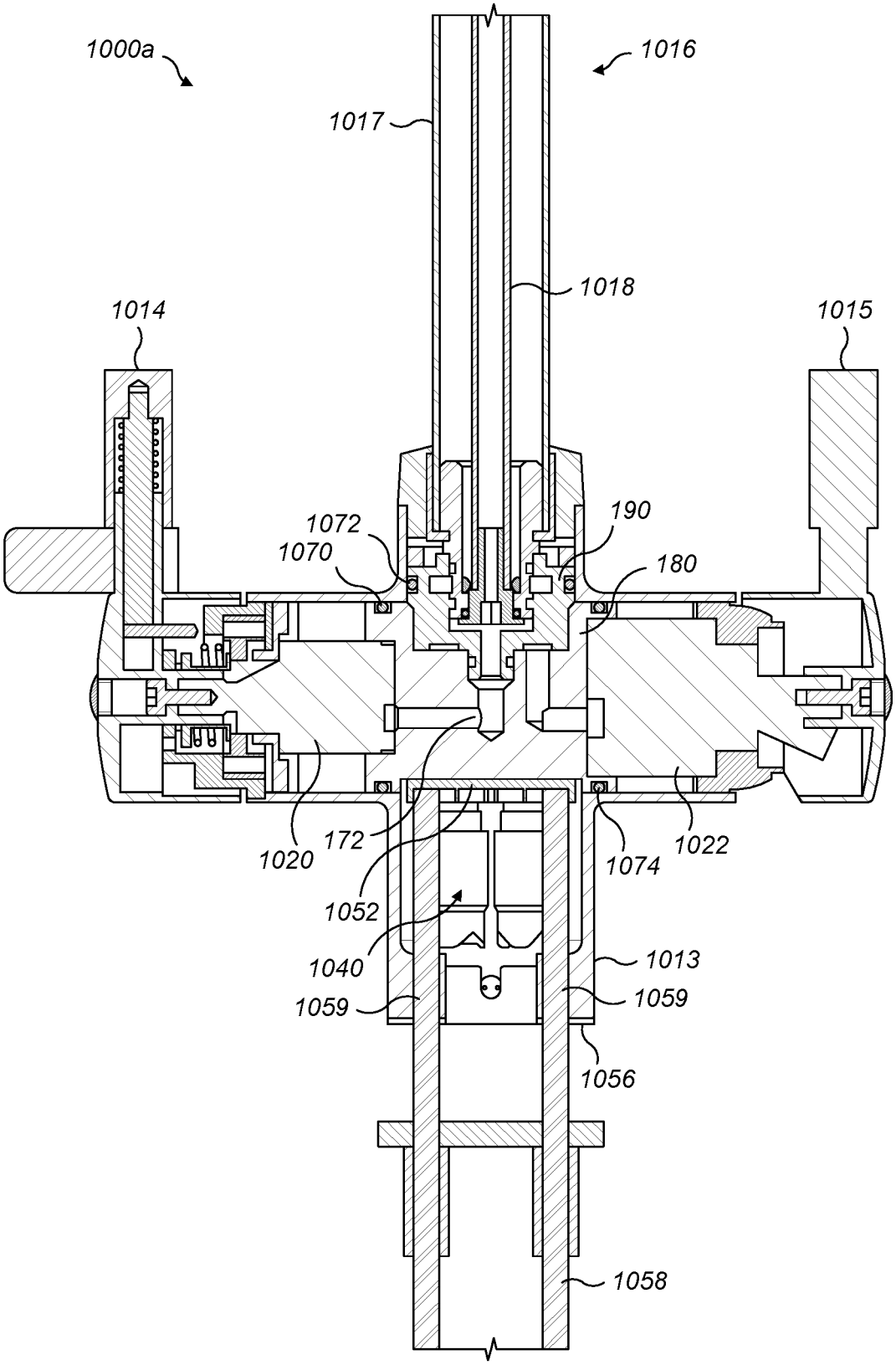
FIG. 2*a* shows a cross-sectional view of a tap according to another example.

Referring now to FIG. 2*a*, there is shown a longitudinal cross-sectional view of a second example of a tap 1000*a*. The tap 1000*a* shown in FIG. 2*a* has a number of similar features to the tap 1000 shown in FIGS. 1*a* and 1*b* and discussed above. These similar features have the same numerals in FIG. 2*a* as they do in FIGS. 1*a* and 1*b* and will not be discussed in detail again.

Figure 2B:
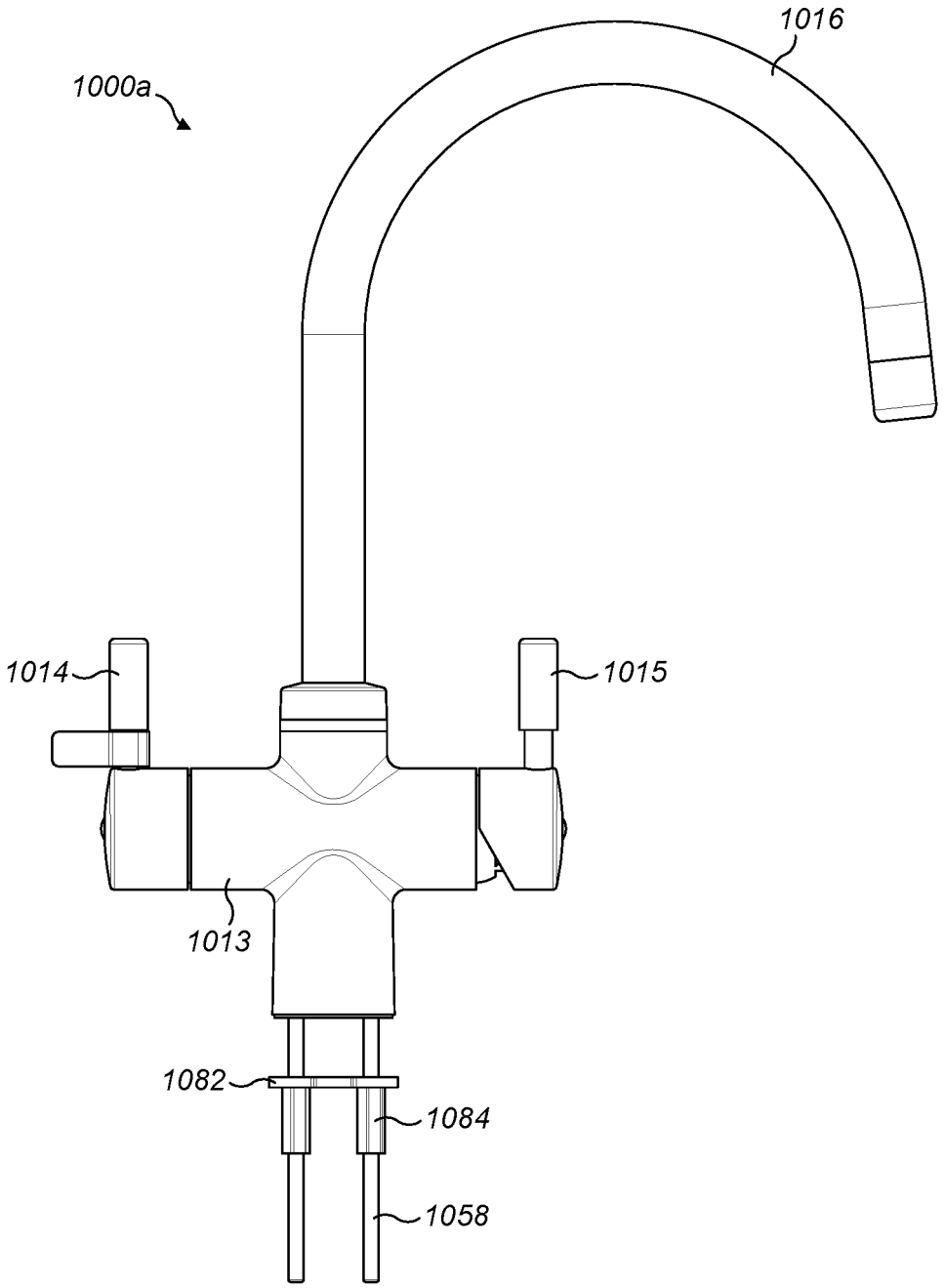
FIG. 2*b* is a front view of the tap of FIG. 2*a;*

As shown more clearly in FIG. 2*b*, the tap 1000*a* shown in FIG. 2*a* comprises a one-piece outer body 1013 that is generally cross-shaped in cross-section (rather than first 1010 and second 1012 outer bodies like the tap 1000 shown in FIGS. 1*a* and 1*b*). The one piece outer body 1013 may typically be made of zinc Mazak, or other zinc alloys, which are relatively cheap materials and which can be used to reduce the relative overall cost of the tap 1000*a*. The separation of the one-piece outer body 1013 from the hot water channels in the tap 1000*a* via the inner body 100*a* enables the selection of any outer body material. This is because there is then no need to select a poor thermal conductor to prevent thermal energy passing through the tap 1000*a* to the user.

In this example, the inner body within the tap 1000*a* is a two-part inner body of the type described below and comprises a first part 180 and a second part 190. The first part 180 of the inner body interfaces with the filtered water and boiling water selector valve 1020 on one side and with the mains hot water and cold water mixer valve 1022 on another side. The second part 190 of the inner body interfaces with the spout 1016. The first part 180 and the second part 190 are removably connectable with one another. Although a two part inner body is shown in an embodiment having a single piece outer body, the two part inner body may also be used in a two piece outer body and similarly a single piece inner body may also be used in the single piece outer body. Although it will be appreciated that a two piece inner body may be more easily insertable in a one-piece outer body.

Figure 2C:
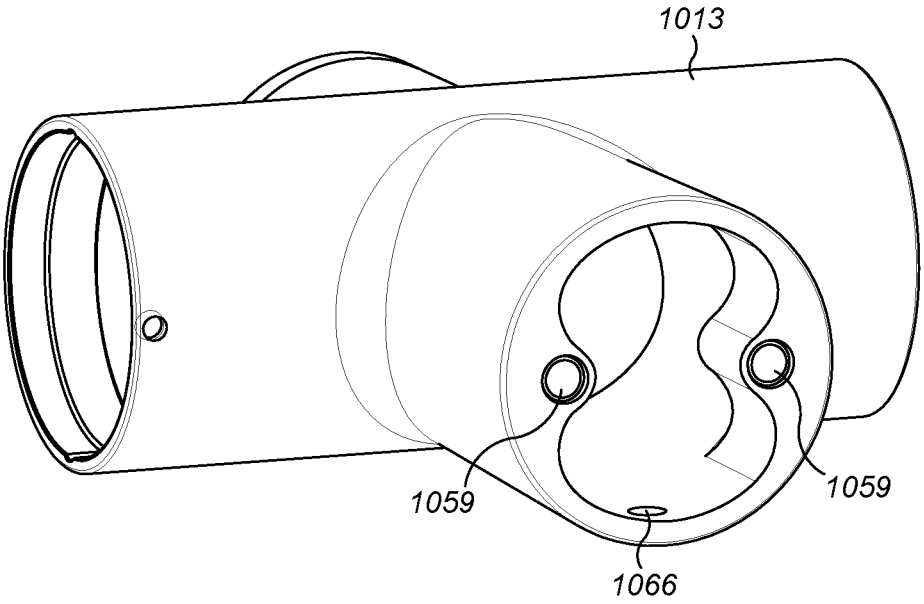
FIG. 2*c* is a perspective underside view of the outer body of the tap of FIG. 2*a;*

As shown in FIG. 2*c*, the tap outer body is made from metal or another material in which it is suitable to provide a threaded bore. The two clamping studs 1058 are held within respective threaded bores 1059 at opposed sides of the base of the tap outer body. Each clamping stud may thus made from metal or another material on which it is suitable to provide a thread to be received in the threaded bore.

Figure 2D:
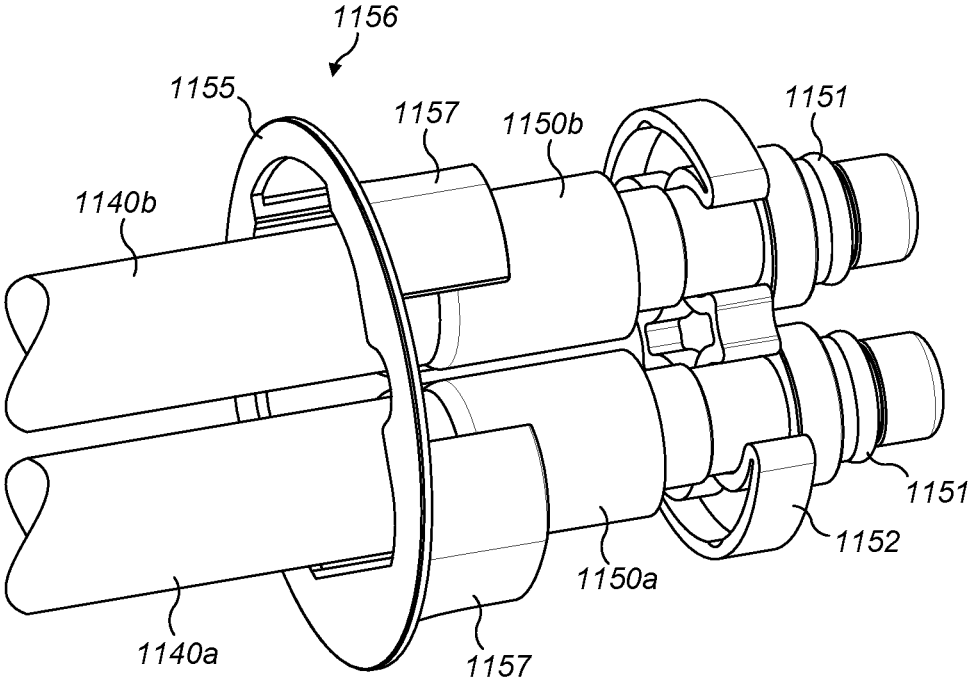
FIG. 2*d* is a perspective view showing the connectors for the tap of FIG. 2*a;*
Figure 2E:
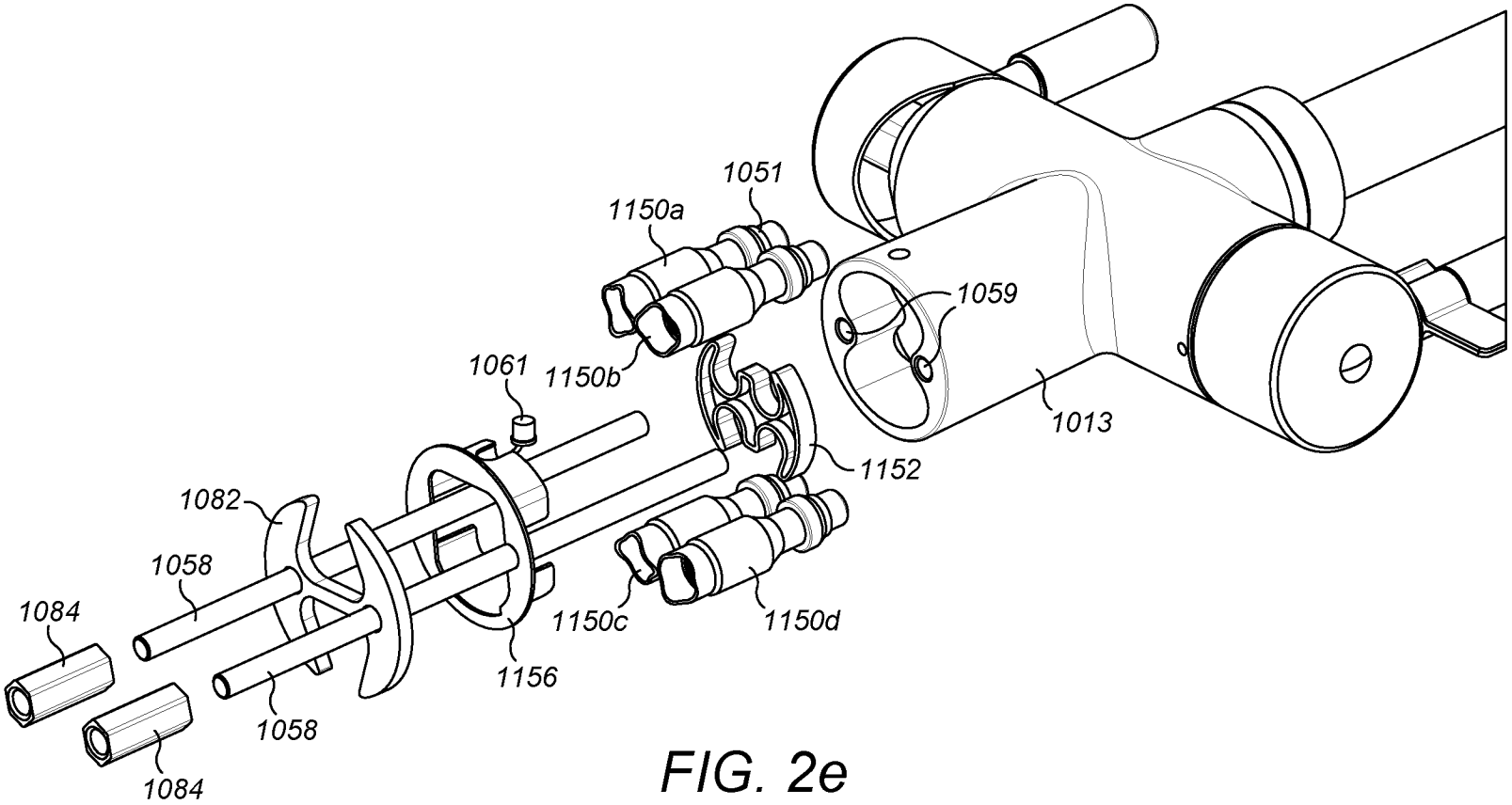
FIG. 2*e* is an exploded isometric view showing various components in the tap of FIG. 2*a;*

As shown in FIGS. 2*d* and 2*e*, there are again four hoses 1140*a*, 1140*b* of the type described above having four connectors 1150*a*, 1150*b*, 1150*c*, 1150*d* which are push-fitted into the first to fourth water inlets of the first part 180 of the inner body and which are used to connect the inner body to a mains hot water source, a mains cold water source, a filtered water source and a boiling filtered water source. In use, a user may use the first handle 1014 to set the first valve 1020 to control the dispensing of filtered water or boiled filtered water from the inner spout 1018 and use the second handle 1015 to set the second valve 1022 to control the dispensing of mixed mains cold and mains hot water from the outer spout 1017.

The four hoses are held in place by use of a hose retaining member 1152, a base insert 1156 and a pair of clamping studs 1058. However, in contrast to the previous embodiment, the clamping studs 1058 are not received within corresponding threaded bores in the clamping insert. In this embodiment, the clamping studs pass through the base insert 1156, through the threaded bores 1059 in the tap body, and push the hose retaining member 1152 against the lower surface of the inner body. Thus, the clamping studs 1058 do not pass through the hose retaining member 1152 nor into the inner body.

The base insert 1156 comprises a generally annular ring 1155 with a plurality of flanges 1157 (in this example, three) extending perpendicularly to the annular ring. When the base insert 1156 is inserted into the base of the tap body, the flanges 1157 contact the inner walls of the tap body. A slot between two flanges supports an LED 1061 or similar light and the flange pushes the LED through a corresponding aperture 1013 in the outer body so that it is visible in use to a user. As before, the base insert 1156 rests on the work surface and acts as a seal. The height of the flanges 1157 is such that the flanges 1157 contact the base of the connectors and/or the hose retaining member to help hold the connectors in place within the non-threaded bores. Each connector 1150*a, b, c, d* has an O-ring 1151 to partially secure the connector in the non-threaded bore and to provide a water-tight seal.

As shown most clearly in FIG. 2*a*, the tap 1000*a* has a number of O-rings 1070, 1072, 1074 for preventing water from leaking throughout the tap 1000*a* in the event of a failure of the spout or valves 1020, 1022. A first O-ring 1072 is located between the second part 190 of the inner body 100 and the outer body 1013 around the base of the spout 1017 to prevent leakages from the spout spreading to the rest of the tap 1000*a*. A second O-ring 1070 is arranged around the inner body 100*a* adjacent the end of the filtered and boiling valve 1020 which interfaces with the inner body and prevents leakage from the filtered and boiling valve 1020 spreading to the rest of the tap 1000*a*. Similarly, a third O-ring 1074 is arranged around the inner body 100*a* adjacent the end of the mains hot and cold valve 1022 which interfaces with the inner body and prevents leakage from the mains hot and cold valve 1022 spreading to the rest of the tap 1000*a*.

Figure 3A:
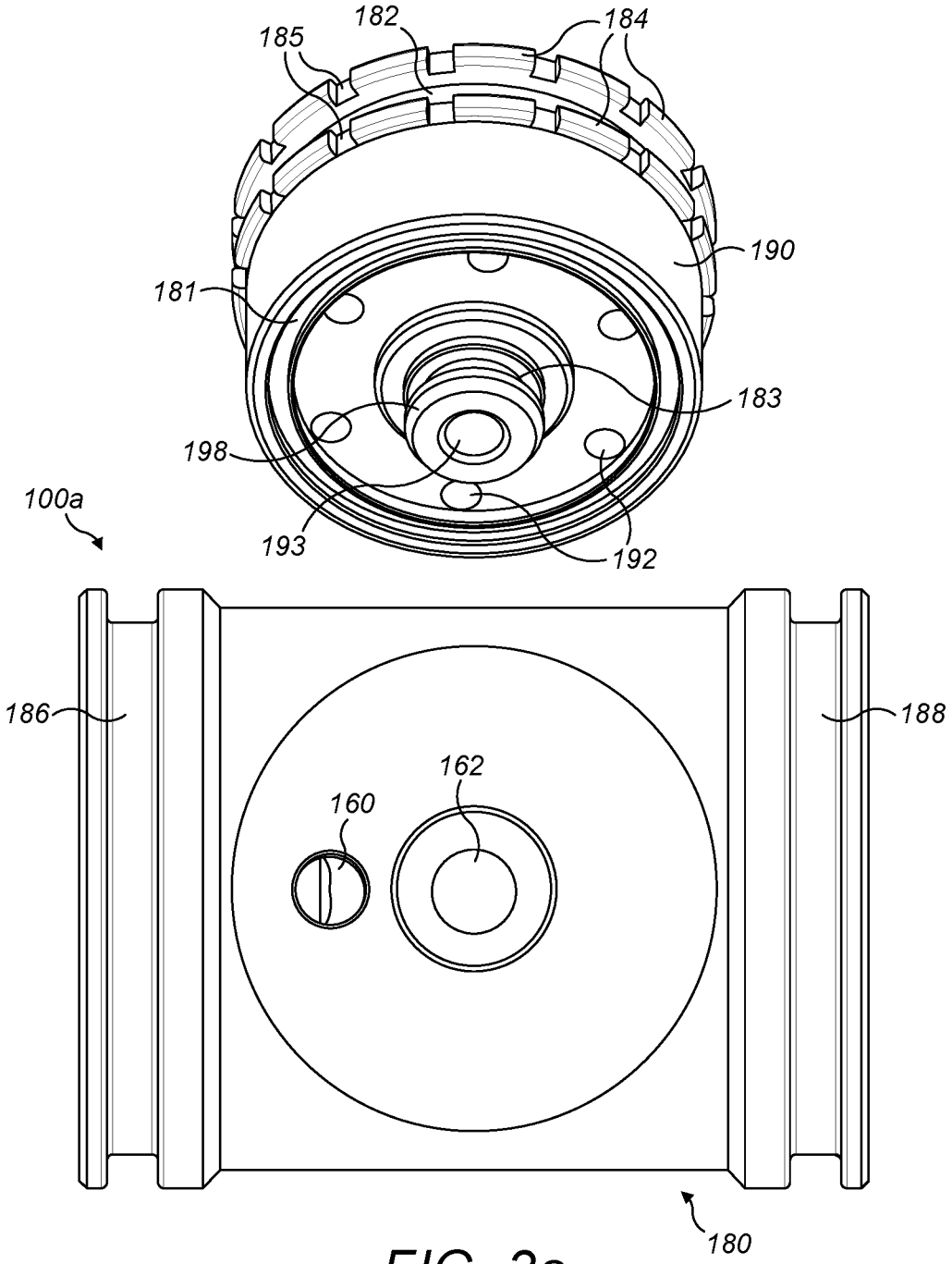
FIG. 3*a* shows an exploded perspective view of the inner body of the tap of FIG. 2*a;*
Figure 3B:
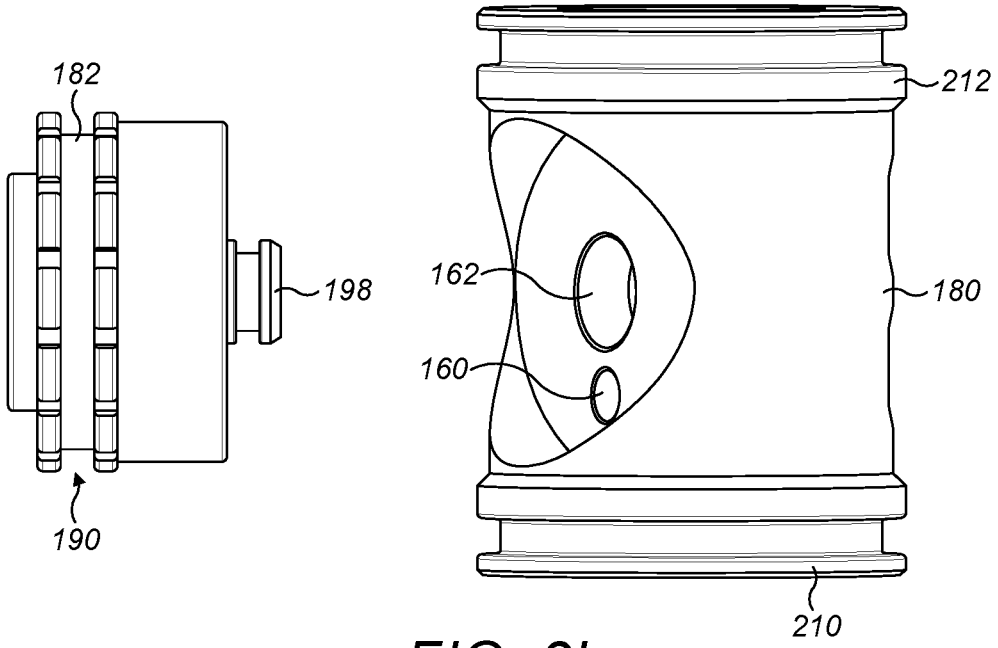
FIG. 3*b* shows an alternative exploded perspective view of the inner body of FIG. 3*a;*

FIGS. 3*a* to 3*e* show a two-piece inner body which could be used in the arrangement of FIG. 2*a*. FIGS. 3*a* and 3*b* show that the first part 180 is substantially cylindrical in shape and the second part 190 may also be substantially cylindrical in shape. The second part 190 may be removably connectable to the first part 180 by an interference connection or "push" fit. The second part 190 comprises a projection 198 which engages with the water outlet 162 which is located substantially centrally of the first part 180 of the inner body. The projection 198 comprises a channel 183 which locates an O-ring. This O-ring may provide the interference fit between the first and second part and also reduce the risk of leaks between the two parts. There is also a channel 181 in the base of the second part 190 into which an O-ring can be located to also reduce the risk of leaks between the two parts.

The second part 190 is provided with a channel 182 into which the first O-ring shown in FIG. 2*a* may be mounted to provide a water tight seal as explained above. On either side of the first channel 182, there is a series of projections 184 separated by recesses 185. The use of projections 184 and alternating recesses creates a larger surface area to reduce heat transmission from the water within the inner body to the tap body. These projections 184 are on the tap engaging surface. These projections 184 also allow any expansion from heat to be transferred around the circumference of the second part rather than radially to push against the outer body.

The other outlet 160 on the first part 180 is laterally offset from the central water outlet 162. As shown, the inlet 192 on the second part 190 which communicates with the outlet 160 from the mixer valve comprises a plurality (e.g. six) of separate apertures. The overall surface area of the plurality of apertures corresponds to the surface area of the outlet 160 to maintain the flow between the two parts without increasing the pressure within the two parts. In use, water flows into the channel around the projection 198 from the outlet 160 before passing into the plurality of apertures to exit the tap through the outer portion of the spout.

Alternatively, the connection between the first part 180 and the second part 190 may be achieved by a fastener, by welding or by adhesion rather than by the use of a press-fit. Use of a cylindrical shape enables the inner body 100*a* to be used in a tap with a cylindrical configuration. However, it will be appreciated that the first and second parts 180, 190 may be of any shape or size suitable for inclusion in a tap.

As shown in FIG. 3*b*, the first part 180 of the inner body has opposed pairs of tap-engaging surfaces 210, 212 which help secure the inner body within the tap to prevent movement of the inner body. Each tap-engaging surface 210, 212 has a groove 186, 188 around its circumference into which a resilient seal such as an O-ring is mounted to form a water tight seal. These seals may be the second and third O-rings as described above.

Figure 3C:
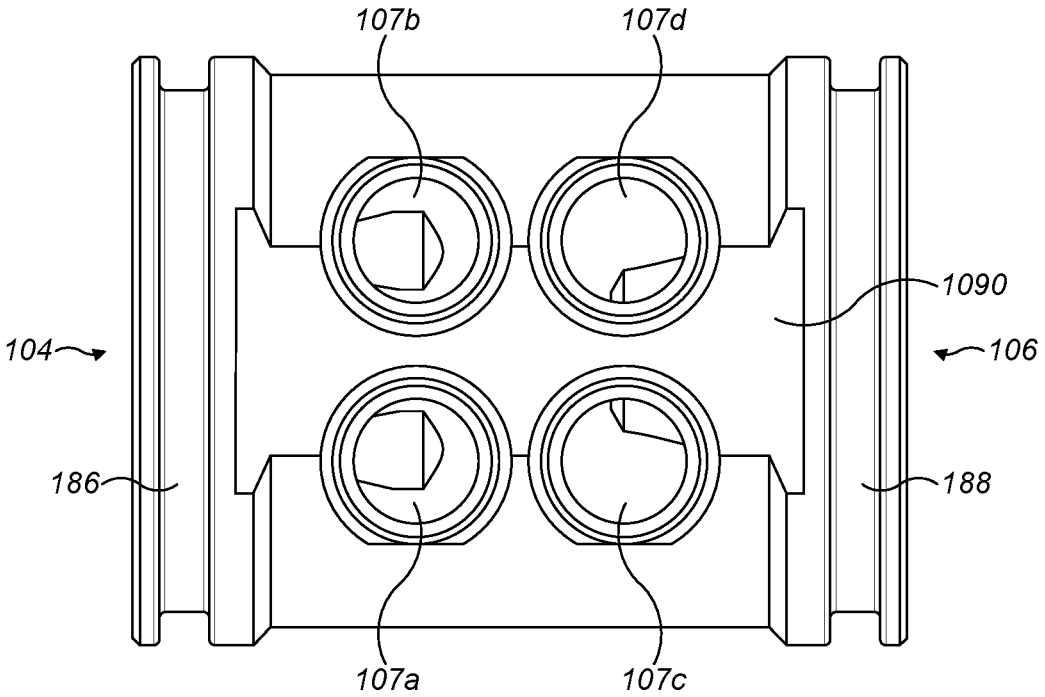
FIGS. 3*c*, 3*d* and 3*e* are underside and respective side views of the inner body of FIG. 3*a;*

FIG. 3*c* shows the four non-threaded bores 107*a*, 107*b*, 107*c*, 107*d* into which the connectors for the hoses are received. As explained above, the clamping studs push the hose retaining member against the lower surface of the inner body to help retain the connectors in the non-threaded bores of the inner body. Accordingly, the base of the second body 190 is shaped to provide a good fit to the hose retaining member. Thus, the base has a contact portion 1090 which abuts the hose retaining member. Since the hose retaining member is generally planar, the contact portion 1090 is also flat. In this way, the hose retaining member contacts the contact portion over the majority of the surface.

Figure 3D:
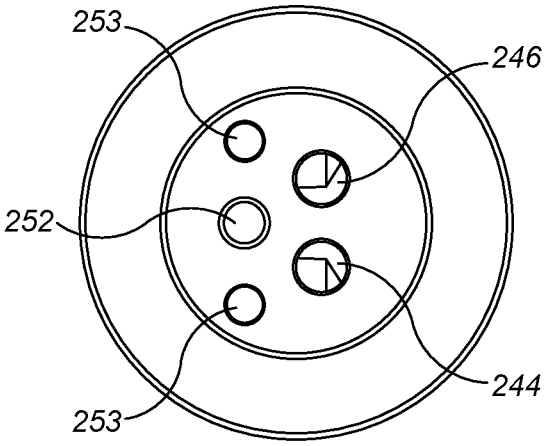
Figure 3E:
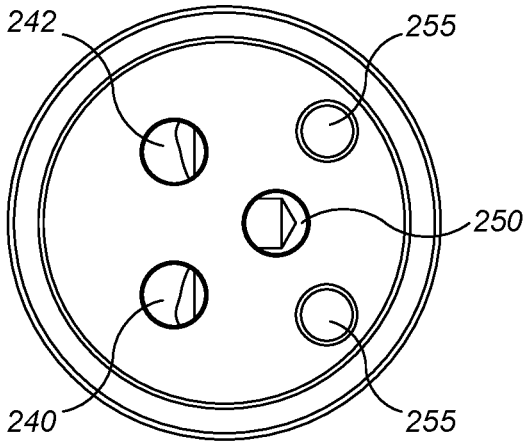

FIG. 3*d* shows the outlets 244, 246 and the inlet 252 in the surface which interfaces with the selector valve. The selector valve also typically has two locating projections which engage with locating recesses 253 in the surface 206. FIG.

3*e* shows the outlets 240, 242 and the inlet 250 in the surface 204 which interfaces with the mixer valve. The mixer valve also typically has two locating projections which engage with locating recesses 255 in the surface. The selector valve is typically smaller than the mixer valve.

Figure 3F:
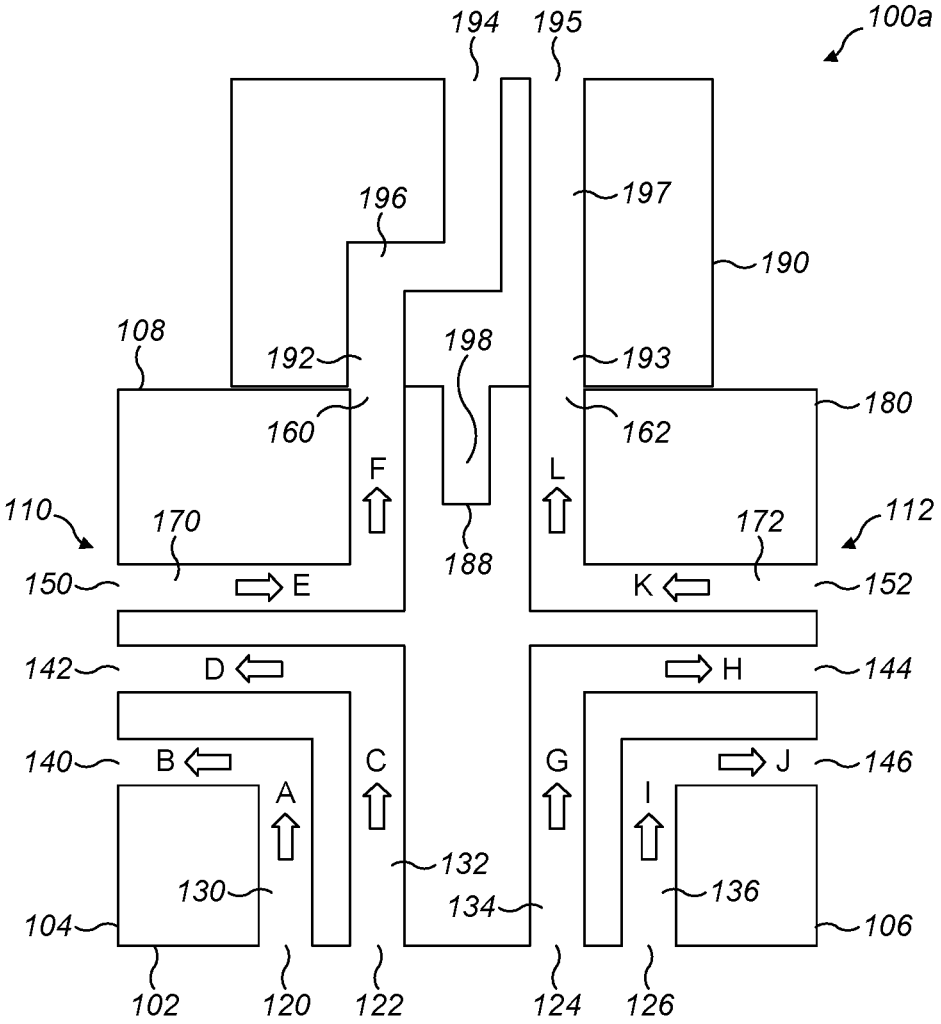
FIG. 3*f* shows a schematic cross-sectional view of the internal configuration of an inner body for the tap of FIG. 2*a;*

FIG. 3*f* schematically shows how water routes through the inner body 100*a*. Although the inner body 100*a* is formed from two pieces, there are features in common with the inner body 100 described above and thus the same reference numbers are used. The first part 180 comprises the channels 130, 132, 134, 136, 170, 172, inlets 120, 122, 124, 126, 150, 152 and outlets 140, 142, 144, 146, 160, 162 of the inner body described above. The second part 190 comprises two inlets 192, 193 which are in fluid communication with the further water outlets 160, 162 of the first part 180. The second part 190 also comprises further outlets 194, 195 which are connected to the two inlets 192, 193 by channels 196, 197. [92]. Following appropriate activation of a handle by a user, water from a first source (i.e. cold mains water) flows in the direction of arrows A and B and water from a second source (i.e. hot mains water) flows in the direction of arrows C and D. These two flows are mixed and the flow of the mixed temperature water is shown by arrows E and F; this flow enters the inner body at inlet 150 and exits the inner body at outlet 160. Similarly, following appropriate activation of a handle by a user, water from a third source (i.e. filtered water) flows in the direction of arrows G and H and water from a fourth source (i.e. boiling water) flows in the direction of arrows I and J. These flows are not mixed and the flow from the selected source enters the inner body at inlet 152, flows along the channel in the direction shown by arrows K and L and exits the inner body at outlet 162.

The selector valve prevents mixing of the water from the third and fourth sources, perhaps because the user does not wish to mix the sources, which might be, for example, filtered and boiling water, or boiling water and sparkling water, or sparkling water and filtered water. Water may flow into the inner body through both inlets 150, 152 at the same time and thus a mix of water may be delivered through the tap if both handles are appropriately activated. As an additional safety feature, use of the boiling water source may require continuous activation of the appropriate handle against a biasing element otherwise flow from the source is cut off as described for example in EP2990703 to the present applicant which is herein incorporated by reference.

Figure 4A:
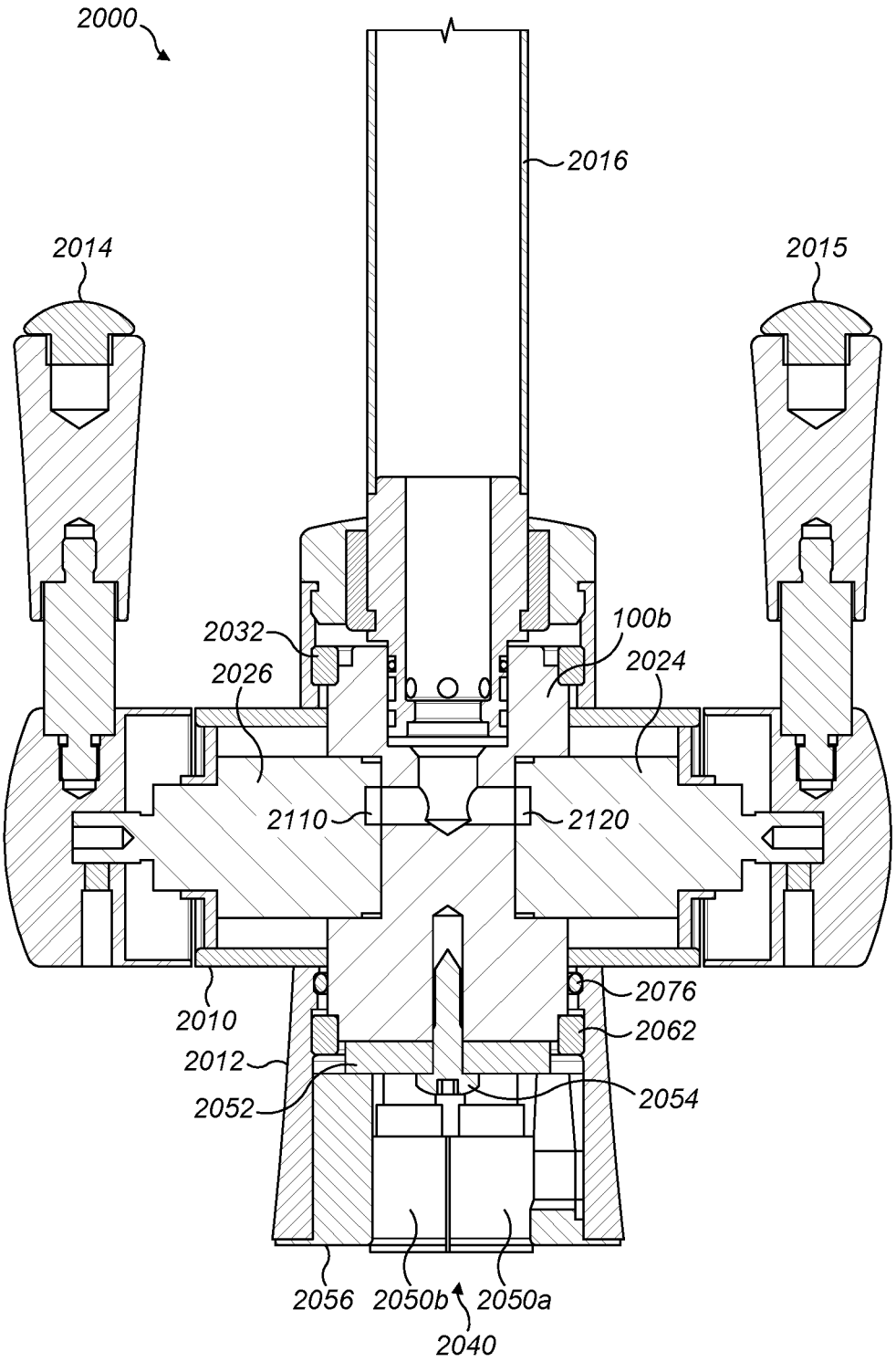
FIG. 4*a* shows a cross-sectional front view of a tap according to an example.

FIG. 4*a* shows another tap 2000 which is a dual-lever mono-mixer tap and which incorporates an inner body for directing fluid flow from the water sources through the tap spout 2016. The tap 2000 has a number of features which are the same or substantially the same as taps described above. These features have the same numerals as used previously but with the numerals increased by 1000. These features include, for example, first outer body piece 2010 and second outer body piece 2012 among others. The first outer body piece 2010 and second outer body piece 2012 are the same shape and design as those shown in FIG. 1*a*. In contrast to the taps described above, the tap 2000 shown in FIG. 4*a* mixes just mains hot and cold water. Accordingly, the tap 2000 comprises a mains cold water valve 2024 and a mains hot water valve 2026, rather than the selector and mixer valves shown above.

A single piece inner body 100*b* which is similar to that shown in FIG. 1*f* interfaces with both valves. The inner body 100*b* comprises a pair of indentations into which an end of each valve is located. The number of inlets and outlets within inner body 100*b* is reduced compared to the inner body within the four tap inner body described above. The inner body comprises a first inlet and a first outlet connected by a channel to route mains hot water to the mains hot water valve 2026 and a second inlet and a second outlet connected by a channel to route mains cold water to the mains cold water valve 2026. The single-piece inner body further comprises a first additional inlet and a first further outlet 2110 connected by a channel to route mains hot water from the mains hot water valve 2026 to the spout 2016 and a second additional inlet connected by a channel to the second further outlet 2120 to route mains cold water from the mains cold water valve 2024 to the spout.

There are two connectors 2050*a*, 2050*b* of the type described above with respect to FIG. 1*e* which are push-fitted into the first inlet and the second inlet of the inner body and which are used to connect the inner body to a mains hot water source and a mains cold water source. Again, flexible tubing 2040 may be used to connect the hoses to the water sources. As in the previous embodiment, the hoses are held in place by use of a hose retaining member 2052 and a base insert 2056. The hose retaining member 2052 may be secured to the inner body 100*b*, for example, by a self-tapping screw 2054.

In use, a user may use a first handle 2014 to set the mains hot water valve 2026 to control the dispensing of mains hot water from the spout 2016 and use a second handle 2015 to set the mains cold water valve 2026 to control the dispensing of mains cold water from the spout 2016.

The tap 2000 comprises an O-ring 2076, arranged below the lowest edge of the first outer body piece 2010, but within the second outer body piece 2012. This O-ring 2076 prevents water leaking from the tap 2000 below the work surface in which the tap 2000 is installed when either valve 2024, 2026 fails. Prevention of this type of flooding of the tap is important in keeping repair costs low during a failure event.

Figure 4B:
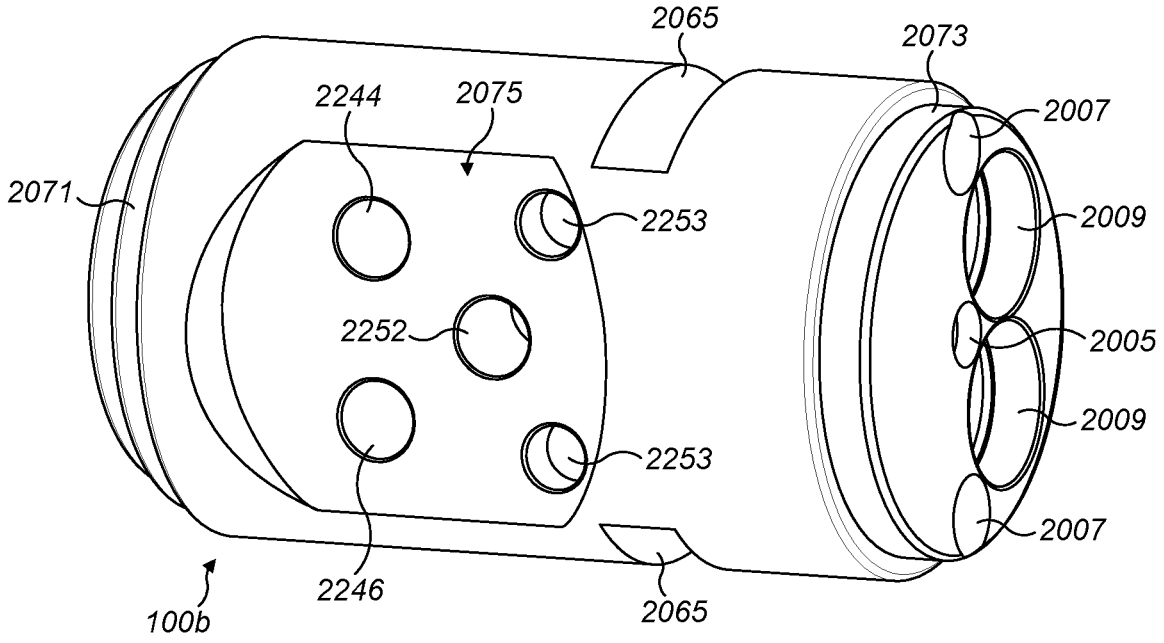
FIG. 4*b* is a perspective view of an inner body for the tap of FIG. 4*a;*
Figure 4C:
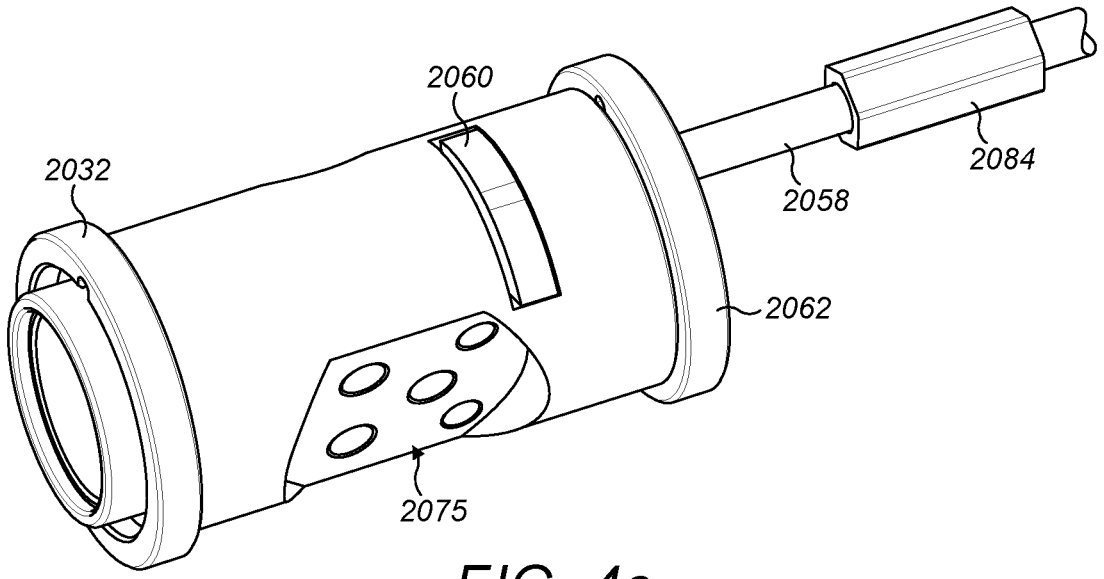
FIG. 4*c* is a perspective view of the inner body of FIG. 4*b* with the clamping insert.

The single piece inner body 100*b* is shown in more detail in FIGS. 4*b* and 4*c*. The inner body 100*b* has a generally cylindrical body with annular projections 2071, 2073 at opposed ends of the cylindrical body. A body retaining nut 2032 slots over the upper projection 2071 on the inner body to connect the inner body 100*c* to the second outer body 2012 at an upper end and a threaded ring 2062 slots over the lower projection 2073 to secure the inner body 100*b* to the second outer body 2012 at a lower end. The body retaining nut 2032 and the threaded ring 2062 are threaded to be secured into threaded bores on an inner surface of the outer body. The inner body 200*b* shown in FIGS. 4*b* and 4*c* comprises first and second portions with the second portion extending beyond the body retaining nut 2032 to help stabilise the spout as described above. A variant is shown in FIG. 4*a* without this feature.

The inner body 100*b* comprises a pair of indentations 2065 on opposed sides of the inner body each of which is aligned with a non-threaded bore 2009 which receives a respective clamping stud. The non-threaded bores are on opposed sides of the inner body and do not interfere with the two non-threaded bores 2007 which each receive a connector. As described above, each elongate clamping stud 2058 is secured in the respective clamping insert 2060 and in the respective threaded bore in the securing nut 2084. This provides a clamping mechanism for securing the tap to a work surface as described in more detail above and illustrated in FIG. 6 below. There is also a central non-threaded bore 2005. This receives the self-tapping screw to secure the hose retaining member to the inner body. The securing effect of the hose retaining member and the base insert ensures that the hoses for delivering water to the tap 2000 are retained within the inner body 100*b* and the tap body via a mechanical clamping arrangement.

Each indentation 2075 comprises the inlets 2244, 2246 and the outlet 2252 which interface with the appropriate valve. Each valve also typically has two locating projections which engage with locating recesses 2253 in the surface.

Figure 5A:
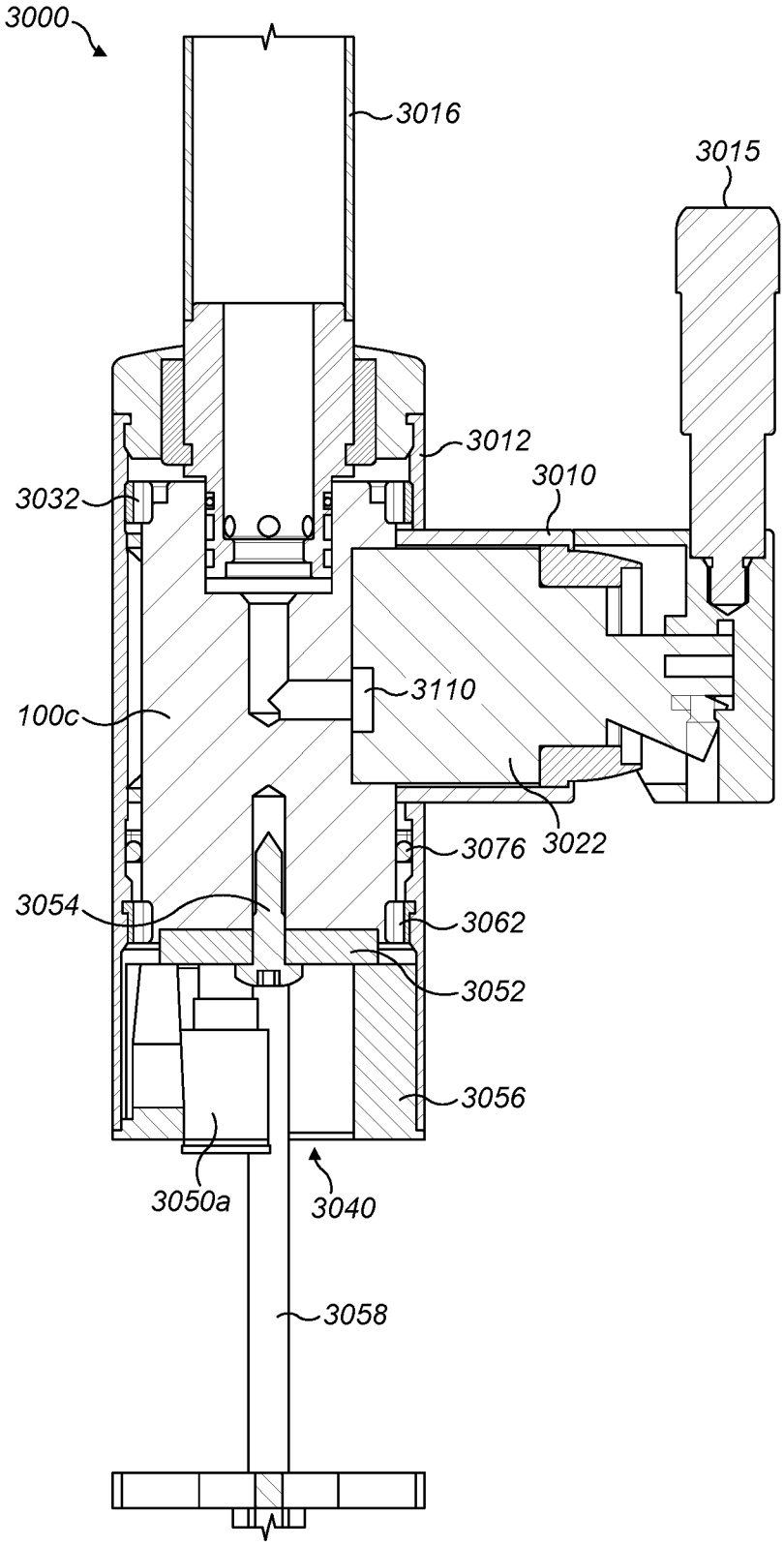
FIG. 5*a* shows a cross-sectional view of a tap according to another example.

FIG. 5*a* shows another tap 3000 which is a single-lever mono-mixer tap and which incorporates an inner body to route water flow. The tap 3000 has a number of features which are the same or substantially the same as taps described above. These features have the same numerals as used previously in FIG. 1*a* but with the numerals increased by 2000. These features include, for example, first outer body piece 3010 and second outer body piece 3012 among others. The first outer body piece 3010 and second outer body piece 3012 are arranged at right angles to one another as those shown in FIG. 1*a*.

Like the tap of FIG. 4*a*, the tap 3000 shown in FIG. 5*a* mixes just mains hot and cold water but in this arrangement, this is achieved by a single mixer valve 3022. A single piece inner body 100*c* which is similar to that shown in FIG. 1*a* interfaces with the valve. The inner body 100*c* comprises an indentation into which an end of the valve is located. The number of inlets and outlets within inner body 100*c* is reduced compared to the inner body within the four tap inner body described above. The inner body comprises a first inlet and a first outlet connected by a channel to route mains hot water to the mixer valve 3022 and a second inlet and a second outlet connected by a channel to route mains cold water to the mixer valve 3022. The single-piece inner body further comprises a first additional inlet and a first further outlet 3110 connected by a channel to route mixed water to the spout 3016.

There are two connectors 3050*a*, 3050*b* of the type described above with respect to FIG. 1*e* which are push-fitted into the first inlet and the second inlet of the inner body and which are used to connect the inner body to a mains hot water source and a mains cold water source. Again, flexible tubing 3040 may be used to connect the hoses to the water sources. As in the previous embodiment, the hoses are held in place by use of a hose retaining member 3052 and a base insert 3056. The hose retaining member 3052 may be secured to the inner body 100*d*, for example, by a self-tapping screw 3054. There is also a resilient seal, e.g. in the form of an O-ring, around the surface of each connector which forms a water-tight seal. As described above, these components may be considered to form part of the clamping mechanism.

As before the base insert 3056 comprises a generally annular ring with a plurality of flanges which fit against the inner walls of the tap body so that the base insert 3056 forms a seal when the tap is in place on a work surface. Each elongate clamping stud is also secured in the respective clamping inserts 3060 which are within recesses in the inner body and these clamping studs 3058 form part of a securing mechanism for securing the tap to the work surface. A body retaining nut 3032 slots over an upper projection on the inner body to connect the inner body 100*c* to the second outer body 3012 at an upper end and a threaded ring 3062 slots over the lower projection to secure the inner body 100*d* to the second outer body 3012 at a lower end.

In use, a user may use the handle 3015 to set the mixer valve 3022 to control the dispensing of mixed mains hot and cold water from the spout 3016. To prevent leaks as before, the tap 3000 comprises an O-ring 3076, arranged below the lowest edge of the first outer body piece 3010, but within the second outer body piece 3012.

Figure 5B:
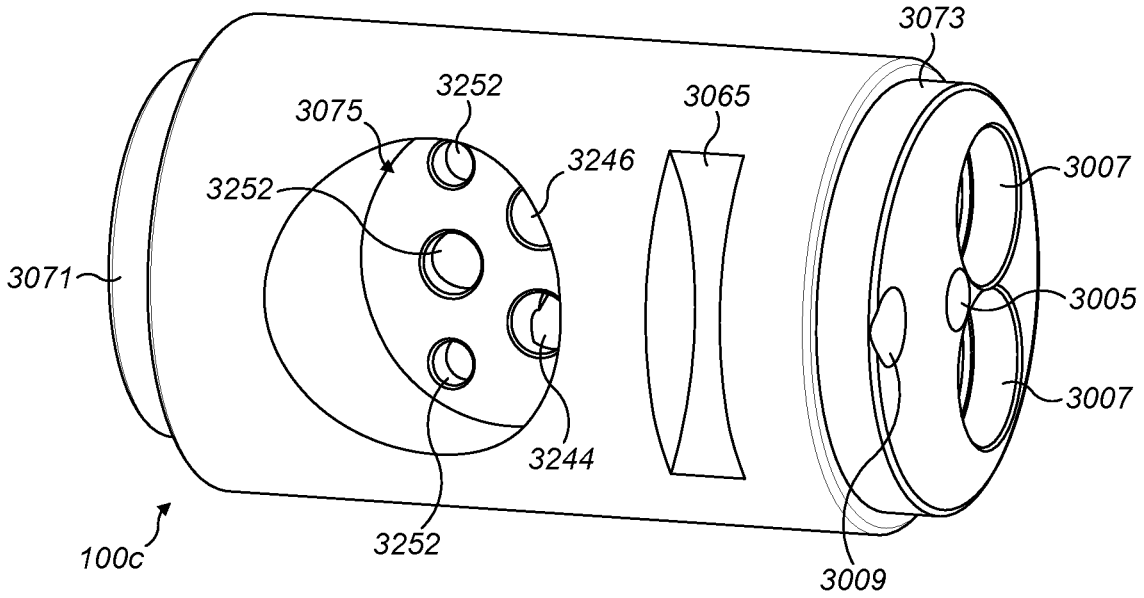
FIG. 5*b* is a perspective view of an inner body for the tap of FIG. 5*a;*
Figure 5C:
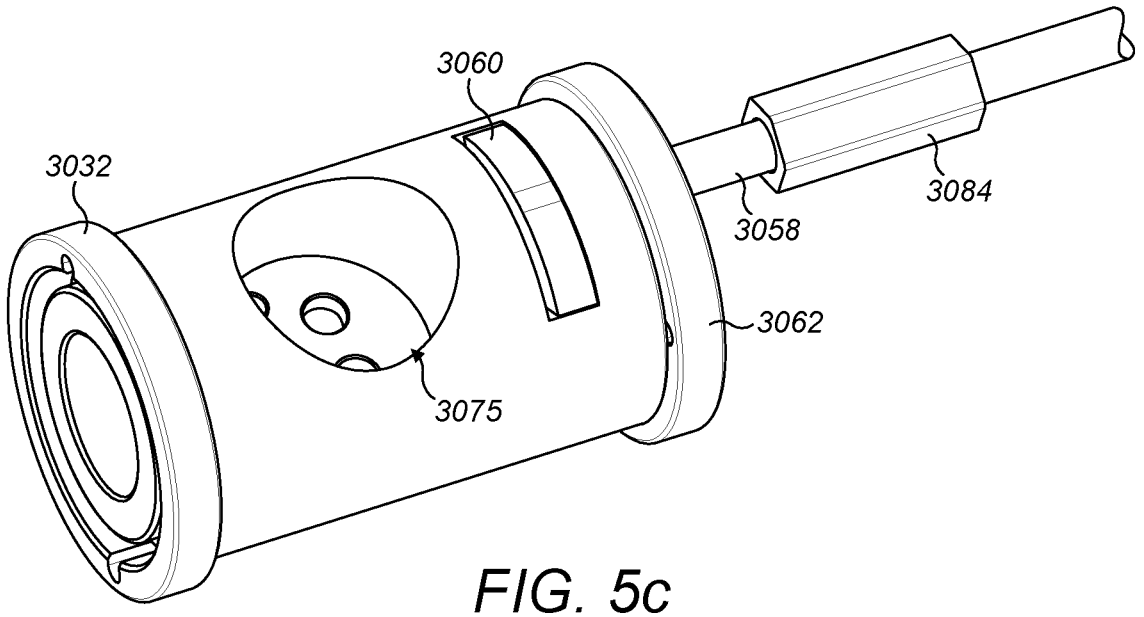
FIG. 5*c* is a perspective view of the inner body of FIG. 5*b* with the clamping insert.

The single piece inner body 100*c* is shown in more detail in FIGS. 5*b* and 5*c*. The inner body 100*c* has a generally cylindrical body with annular projections 3071, 3073 at opposed ends of the cylindrical body. A body retaining nut 3032 slots over the upper projection 3071 on the inner body to connect the inner body 100*c* to the second outer body 3012 at an upper end and a threaded ring 3062 slots over the lower projection 3073 to secure the inner body 100*c* to the second outer body 3012 at a lower end. The body retaining nut 3032 and the threaded ring 3062 are threaded to be secured into threaded bores on an inner surface of the outer body. The inner body 100*c* shown in FIGS. 5*b* and 5*c* has an upper projection which does not protrude beyond the body retaining nut 3032.

In contrast to the previous embodiments, the inner body 100*c* comprises a single indentation 3065 which is aligned with a single non-threaded bore 3009 which receives a respective clamping stud. The non-threaded bore does not interfere with the two non-threaded bores 3007 which each receive a connector. As described above, the elongate clamping stud 3058 is secured in the clamping insert 3060 and in the threaded bore in the securing nut 3084. This provides a clamping mechanism for securing the tap to a work surface as described in more detail above and illustrated in FIG. 6 below. It will be appreciated that this embodiment may also be adapted to use two clamping studs for more stability. There is also a central non-threaded bore 3005. This receives the self-tapping screw to secure the hose retaining member to the inner body.

In this arrangement, there is only a single valve and thus only a single indentation 3075 comprising the inlets 3244, 3246 and the outlet 3252 which interface with the valve. The selector valve also typically has two locating projections which engage with locating recesses 3253 in the surface.

Figure 6:
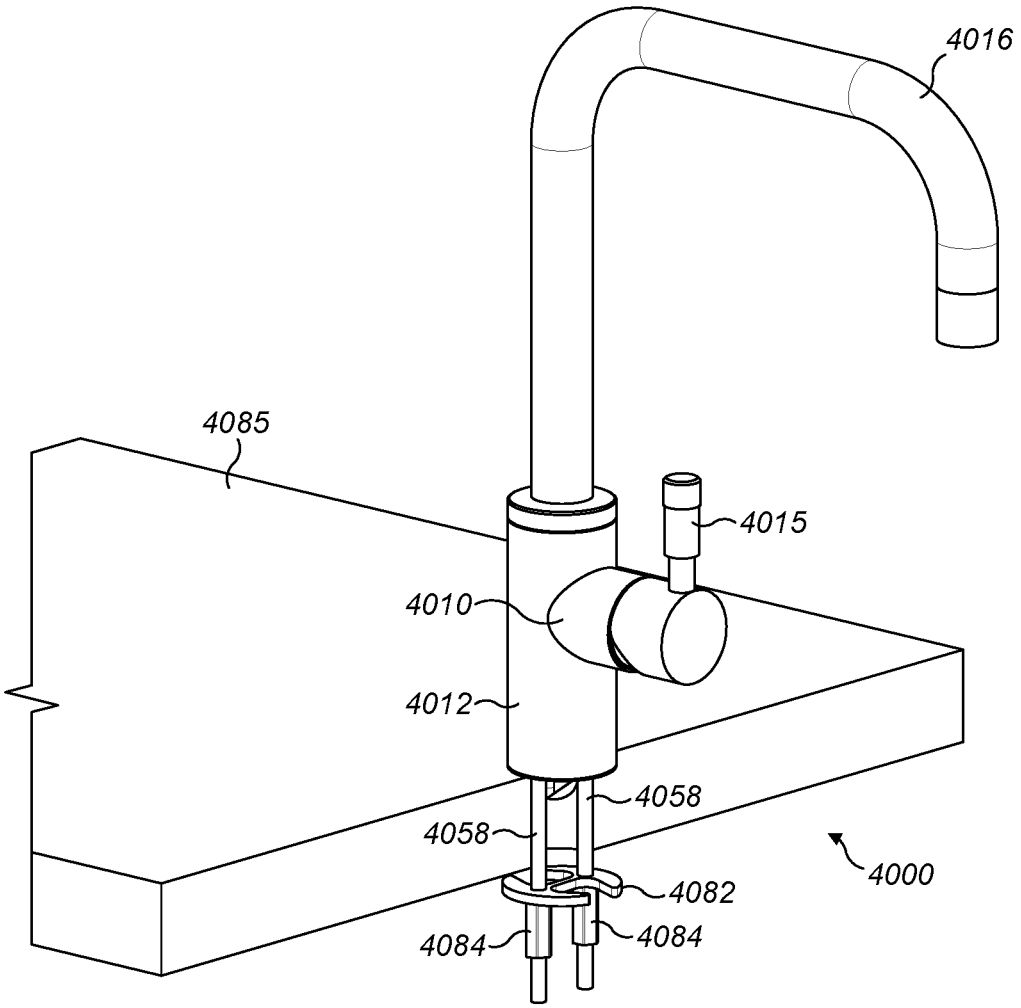
FIG. 6 is a perspective view of a tap showing a securing mechanism

The securing mechanism for securing the tap to a work surface is shown more clearly in FIG. 6. Although FIG. 6 shows a single lever tap, it will be appreciated that the securing mechanism can be used with any of the arrangements shown above. The elongate clamping studs 4058 may also be used to robustly connect the tap 4000 to a work surface 4085. A work surface securing member 4082 is spaced from the tap body by the height of the work surface. The securing member 4082 abuts and thus co-operates with a pair of securing nuts 4084 each having a threaded bore which engages a respective elongate clamping stud 4058. The elongate clamping studs 4058 are screwed into the threaded bores in the securing nuts 4084 to ensure a robust connection of the tap to the work surface. The work surface securing member 4082 comprises a pair of apertures for receiving the hoses from the water sources. The apertures can receive a single or a pair of hoses depending on the tap, e.g. for a four way tap, a pair of hoses is received in each aperture.

Whilst water has been described above as a medium guided and directed by the inner bodies, the inner body may receive any liquid suitable for being delivered by a domestic water tap. The water sources may in examples be combined into fewer water sources. In some examples there may only be one or two or three water sources. In some examples there may be more water sources.

The above embodiments are to be understood as illustrative examples of the invention. Further embodiments of the invention are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. A tap comprising:

an outer body;

an inner body which is housed within the outer body and which comprises at least one flow channel in which water can flow through the tap without contacting the outer body; and a work surface securing mechanism to secure the tap to a work surface, wherein the inner body is made of plastics, is a unitary body, and comprises:

at least one first non-threaded bore configured for receiving a non-threaded connector for delivering water from a source into the inner body;

at least one second non-threaded bore configured for receiving at least one threaded clamping stud; and at least one metal insert located in an indentation on an outer surface of the inner body, the at least one metal insert comprising a threaded bore which is aligned with the at least one second non-threaded bore and which is configured to receive the at least one clamping stud to secure the at least one clamping stud to the inner body, wherein the work surface securing mechanism comprises at least one clamping nut which in use is located under the work surface, and wherein the at least one clamping stud is located in the at least one second non-threaded bore in the inner body and in a first threaded bore in the at least one clamping nut.

2. The tap of claim 1, wherein the work surface securing mechanism further comprises a work surface securing member which in use is held against the underside of the work surface by the at least one clamping nut.

3. The tap of claim 1, wherein the inner body comprises a pair of metal inserts located in indentations on opposed outer surfaces of the inner body with each metal insert comprising a threaded bore which is aligned with a corresponding second non-threaded bore in the inner body.

4. The tap of claim 1, wherein the at least one second non-threaded bore extends along approximately one-third of the length of the inner body.

5. The tap of claim 1, wherein the outer body comprises at least one threaded bore and the tap comprises a stabiliser having a threaded surface which is mounted on an end of the inner body to secure the inner body to the at least one threaded bore in the outer body.

6. The tap of claim 5 comprising a pair of stabilisers, one mounted on each end of the inner body.

7. The tap of claim 1, further comprising at least one valve which is located in an indentation in the inner body and at least one resilient seal around the inner body below the indentation.

8. A tap system comprising:

a tap comprising:

an outer body; and an inner body which is housed within the outer body and which comprises at least one flow channel in which water can flow through the tap without contacting the outer body;

at least one hose for connecting the tap to a water source, the at least one hose comprising a non-threaded connector for delivering water from the source into the inner body;

a hose retaining member having a slot for each non-threaded connector;

a base insert which in use is configured to act as a seal at a base of the tap; and a clamping mechanism comprising at least one threaded clamping stud;

wherein the outer body is made of plastics and comprises at least one first non-threaded bore configured for receiving the non-threaded connector, and wherein the clamping mechanism is used to secure the tap to a work surface and to secure each non-threaded connector to the inner body.

9. The system of claim 8, wherein the hose retaining member has a slot into which each non-threaded connector is releasably mounted.

10. The system of claim 8, wherein the inner body comprises a non-threaded bore in its base and wherein the hose retaining member is secured to the inner body with a fixing inserted in the non-threaded bore.

11. The system of claim 8, wherein the at least one clamping stud abuts the hose retaining member to keep the hose retaining member in contact with a base of the inner body wherein the hose retaining member and the at least one clamping stud act as the clamping mechanism to secure each non-threaded connector to the inner body.

12. The system of claim 8, wherein the base insert surrounds the at least one hose is mounted in the base of the outer body, and has a flange which contacts a base of the hose retaining member to support a holding of each non-threaded connector in place within the at least one first non-threaded bore.

13. The system of claim 8, wherein the base insert comprises a slot to support an LED within an aperture in the outer body.

14. The system of claim 8, further comprising a resilient seal around a surface each non-threaded connector wherein the resilient seal acts as a clamping mechanism to secure each non-threaded connector within the at least one first non-threaded bore in the inner body.

15. The system of claim 8, further comprising a plurality of water sources, including a boiling water source.

16. The system of claim 8, wherein the inner body is made of polyoxymethylene, nylon or PTFE.

17. The system of claim 8, wherein the at least one first non-threaded bore is configured so that each non-threaded connector received within the at least one first non-threaded bore is free to rotate.

18. The system of claim 8, wherein the outer body comprises at least one threaded bore.

19. The system of claim 18, wherein the outer body is made of metal.

20. The system of claim 18, wherein the clamping mechanism further comprises at least one clamping nut which in use is located under the work surface, wherein the at least one clamping stud is located in the at least one threaded bore in the outer body and in a threaded bore in the at least one clamping nut.

21. The system of claim 8, wherein the inner body comprises a first part having the at least one first non-threaded bore and a second part located in a recess in an upper surface of the first part.

22. The system of claim 21, wherein the first part comprises a contact portion on its base which is shaped to match the hose retaining member which in use contacts the first part and which secures each non-threaded connector in the at least one first non-threaded bore.

23. The system of claim 21, wherein at least one of the first and second parts comprises a channel housing a resilient seal which contacts an inner surface of the outer body.

24. The system of claim 8, wherein the inner body is a unitary body.

25. The system of claim 24, wherein the inner body comprises at least one second non-threaded bore for receiving the at least one threaded clamping stud and at least one metal insert located in an indentation on an outer surface of the inner body, the at least one metal insert comprising a threaded bore which is aligned with the at least one second non-threaded bore and which is configured to receive the at least one clamping stud to secure the at least one clamping stud to the inner body.

26. The system of claim 8, further comprising a first valve and a second valve, wherein the inner body comprises a first indentation on a first surface and a second indentation on a second surface which is opposed to the first surfaces, and wherein the first valve is located in the first indentation and the second valve is located in the second indentation.

27. The system of claim 8, wherein the clamping mechanism comprises two threaded clamping studs.

* * * * *